US006916131B2

(12) United States Patent
Nakasendo

(10) Patent No.: US 6,916,131 B2
(45) Date of Patent: Jul. 12, 2005

(54) IMAGE FORMING DEVICE CUSTOMIZING THE IMAGE TO FIT THE PAPER LENGTH

(75) Inventor: Takashi Nakasendo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/373,049

(22) Filed: Feb. 26, 2003

(65) Prior Publication Data

US 2003/0160855 A1 Aug. 28, 2003

(30) Foreign Application Priority Data

Feb. 28, 2002 (JP) ..... 2002-055058
Jan. 20, 2003 (JP) ..... 2003-010477

(51) Int. Cl.[7] ..... B41J 29/42; B41J 11/42; B41J 2/385

(52) U.S. Cl. ..... 400/342; 400/579; 347/116

(58) Field of Search ..... 347/116, 234, 347/248, 262, 264, 229, 101, 193, 3; 399/301, 82, 190, 24, 401, 304; 101/93.01, 93.11; 346/103; 702/94; 400/579, 342, 279

(56) References Cited

U.S. PATENT DOCUMENTS 4,920,383 A * 4/1990 Cook ..... 399/304
4,999,674 A * 3/1991 Miyata et al. ..... 399/183
5,065,182 A * 11/1991 Fujita et al. ..... 399/190
5,127,752 A * 7/1992 Courtney ..... 400/342
5,165,072 A * 11/1992 Kurita et al. ..... 358/448
5,339,136 A * 8/1994 Parsons et al. ..... 399/301
5,461,704 A * 10/1995 Wakabayashi et al. ..... 358/1.15
5,576,753 A * 11/1996 Kataoka et al. ..... 347/248
5,864,774 A * 1/1999 Jones ..... 702/94
5,868,069 A * 2/1999 Khalid et al. ..... 101/93.01
5,883,698 A * 3/1999 Kimura ..... 355/38
5,946,527 A * 8/1999 Salgado et al. ..... 399/82
6,031,560 A * 2/2000 Wojcik et al. ..... 347/254
6,042,228 A * 3/2000 Yamada et al. ..... 347/104
6,120,196 A * 9/2000 Matsuda ..... 400/55
6,222,301 B1 * 4/2001 Sakai ..... 310/316.01
6,262,759 B1 * 7/2001 Akiyama et al. ..... 347/250
6,295,077 B1 * 9/2001 Suzuki ..... 347/237
6,356,293 B1 * 3/2002 Chiba ..... 347/262
6,462,838 B1 * 10/2002 Hirata et al. ..... 358/3.05
6,484,008 B2 * 11/2002 Arcaro et al. ..... 399/301
6,618,577 B2 * 9/2003 Omura ..... 399/401
2002/0057326 A1 * 5/2002 Katsuma ..... 347/193
2002/0094119 A1 * 7/2002 Sahadevan ..... 382/132
2003/0133162 A1 * 7/2003 Lupien et al. ..... 358/3.26

FOREIGN PATENT DOCUMENTS

GB 2170934 A * 8/1986 ..... B41J/29/42
GB 2232640 A * 12/1990 ..... B41J/11/42
JP 0200180151 * 9/1999 ..... B41J/21/00

* cited by examiner

*Primary Examiner*—Andrew H. Hirshfeld
*Assistant Examiner*—Wasseem H. Hamdan
(74) *Attorney, Agent, or Firm*—Rabin & Berdo, PC

(57) ABSTRACT

A tandem-type image forming device is provided which includes a plurality of photosensitive drums, a paper edge detecting section to detect a front edge and a rear edge of a sheet of paper, an exposure starting time calculating unit for each of a plurality of photosensitive drums, an exposure inhibiting time calculating unit to inhibit printing, when paper having a length being smaller than a predetermined length of the paper is inserted, on a portion being shorter than preset paper, and a control section to control an entire image forming device. By configuring as above, the tandem-type image forming device can be realized by using only one paper edge detecting sensor and only one detecting circuit. Even when paper having a length being smaller than a preset length of the paper is inserted, no transfer of an image to a place outside of the paper, that is, to a carrying belt occurs.

21 Claims, 11 Drawing Sheets

IMAGE FORMING DEVICE CUSTOMIZING THE IMAGE TO FIT THE PAPER LENGTH

BACKGROUND OF THE INVENTION

1. Field of the Invention

The present invention relates to a tandem-type image forming device, such as a color print engine.

2. Description of the Related Art

In a conventional tandem-type image forming device, generally, a method is employed in which a plurality of image forming units are arranged in a paper carrying direction. The image forming units include photosensitive drums. In such the method, an edge of a sheet of paper is detected for every image forming unit. Print timing is determined for each photosensitive drum based on the time of detecting an edge of a sheet of paper, the position of each of the image forming units, and the carrying speed of the sheet of paper, and printing is initiated sequentially to transfer an image to the sheet of paper.

However, the conventional tandem-type image forming device has problems to be solved as described below. That is, each of the image forming units has to be provided with a paper edge detecting sensor and a detecting circuit. Moreover, if the paper being used is shorter than that required normally for printing, the image is transferred to a place outside the paper, that is, to a carrying belt, a carrying unit such as a carrying roller, or the like. As a result, either the carrying belt is made dirty, or toner is wasteflully consumed.

SUMMARY OF THE INVENTION

In view of the above, it is an object of the present invention to provide a tandem-type image forming device which can be realized by using only one paper edge detecting sensor and one detecting circuit and which, even if paper that is shorter than usual is inserted, does not transfer an image to a place outside the paper. That is, the image is not transferred to a carrying belt, a carrying unit such as a carrying roller, or the like, thus enabling the carrying belt not to be made dirty and toner not to be wastefully consumed and, by temporarily stopping counting even while printing is being done, printing even on a sheet of paper having a length larger than a pre-determined one is made possible without a hitch.

The image forming device of the present invention has a basic structure formed from a plurality of image forming sections that are used for forming a image and respectively arranged apart by a specified distance in a paper carrying direction of a paper carrying path; a paper edge detecting section which is used for detecting the edge of the paper in carrying and placed at the upstream side of the paper carrying direction; and a control section to control the plurality of image forming sections based on the information of the edge detected by the paper edge detecting section.

In the concrete, according to a first aspect of the present invention, there is provided an image forming device comprising:

a plurality of image forming sections, each being arranged apart by a specified distance in a paper carrying direction of a paper carrying path;

a paper edge detecting section being placed nearer to an upstream side than each of said plurality of image forming sections in said carrying direction to detect a front edge of paper being carried on said paper carrying path and to output a front edge detecting signal and to detect a back edge of paper having a length being shorter than a predetermined length of said paper to output an abnormal back edge detecting signal;

an exposure start time calculating unit to calculate, when said edge detecting signal is input from said paper edge detecting section, exposure start time for each of said plurality of image forming sections from a carrying speed of said paper and a distance between said paper edge detecting section and said image forming section in said paper carrying path;

an exposure inhibiting time calculating unit to calculate, when said abnormal back edge detecting signal from said paper edge detecting section is input, exposure inhibiting time for each of said plurality of image forming section from a carrying speed of said paper and a distance between said paper edge detecting section and said image forming section in said paper carrying path; and a control section to control said paper edge detecting section, said exposure start time calculating unit and said exposure inhibiting time calculating unit to transfer a desired image by exposure and to inhibit exposure, when paper having a length being smaller than a preset length of the paper is inserted, on a portion being shorter than preset paper for each of said plurality of image forming sections.

According to a second aspect of the present invention, there is provided an image forming device comprising:

a plurality of image forming sections, each being arranged apart by a specified distance in a paper carrying direction of a paper carrying path;

a paper edge detecting section being placed nearer to an upstream side than each of said plurality of image forming sections in said carrying direction to detect a front edge of paper being carried on said paper carrying path and to output a front edge detecting signal and to detect a back edge of paper having a length being shorter than a predetermined length of said paper to output an abnormal back edge detecting signal;

an image data feeding start time calculating unit to calculate, when said edge detecting signal is input from said paper edge detecting section, image data feeding start time for each of said plurality of image forming sections from a speed of carrying said paper, a distance between said paper edge detecting section and said image forming section on said paper carrying path;

a blank data feeding time calculating unit to calculate, when said abnormal back edge detecting signal is input from said paper edge detecting section, feeding start time of blank data to be fed to each of said plurality of image forming sections based on a carrying speed of said paper and a distance between said paper edge detecting section and said image forming section and feeding terminating time of blank data to be calculated based on a carrying speed of said paper and a distance between said edge detecting section and said image forming section, and a preset length of paper; and a control section to control said paper edge detecting section, said image data feeding time calculating unit, and said blank data feeding time calculating unit to transfer a desired image by exposure for each of said plurality of image forming sections and, when paper having a length being smaller than that having a pre-set length is received, transfer blank data by exposure on a portion being shorter than preset paper for each of said plurality of image forming sections.

In the foregoing, a preferable mode is one that wherein includes a sub-scanning clock generating unit to produce a sub-scanning clock which enables fine line feeding that provides a line feeding interval being shorter than that for an image being transferred from an outside device, and wherein said control section to exert control on said all components based on said sub-scanning clock producing unit.

Also, a preferable mode is one wherein a distance between said paper edge detecting section and said image forming section being placed on a highest upstream in said carrying direction provides a relation of L1<L2, where L1 is a distance of a circumference from an exposure position to a transfer position on said image forming section and L2 is a horizontal distance from said transfer position to said paper edge detecting section.

According to a third aspect of the present invention, there is provided an image forming device comprising:

a plurality of image forming sections, each being arranged apart by a specified distance in a paper carrying direction of a paper carrying path;

a paper edge detecting section being placed nearer to an upstream side than each of said plurality of image forming sections in said carrying direction to detect a front edge of paper being carried on said paper carrying path and to output a front edge detecting signal and to detect a back edge of paper to output an abnormal back edge detecting signal;

a page data transfer starting unit to start a transfer of page data after a lapse of each delay time occurring between a receipt of said end detecting signal and a start of exposure which is calculated from a carrying speed of said paper and a distance between said paper edge detecting section and said plurality of image forming sections in said paper carrying path;

a page data transfer time measuring unit to individually count page data transfer time for each of said plurality of image forming sections and to stop transfer of page data after completion of a predetermined number of counting;

a count stopping unit to have said plurality of image forming sections stop all counting of said plurality of said image forming sections after transfer of page data has been started; and a control section to control said paper edge detecting section, said page data transfer starting unit, said page data transfer time measuring unit, and said count stopping unit so as to transfer a desired image for each of said plurality of said image forming sections and, at a same time, when paper having a length being larger than that having a pre-set length is received, controls said count stopping unit so as to stop counting and to receive said end detecting signal from said paper edge detecting section which causes counting to be restarted to enable a transfer of page data to paper having a number of predetermined counting.

According to a fourth aspect of the present invention, there is provided an image forming device comprising:

a plurality of image forming sections, each being arranged apart by a specified distance in a paper carrying direction of a paper carrying path;

a paper edge detecting section being placed nearer to an upstream side than each of said plurality of image forming sections in said carrying direction to detect a front edge of paper being carried on said paper carrying path and to output a front edge detecting signal and to detect a back edge of paper and to output a back edge detecting signal;

a page data transfer starting unit to start a transfer of page data after a lapse of each delay time occurring between a receipt of said end detecting signal and a start of exposure which is calculated from a carrying speed of said paper and a distance between said paper edge detecting section and said plurality of image forming sections in said paper carrying path;

a page data transfer time measuring unit to individually count page data transfer time for each of said plurality of image forming sections and to stop transfer of page data after completion of a predetermined number of counting;

a paper length counting number setting unit to set a number of counting corresponding to said paper length to a page data transfer time measuring unit; and a control section to control said paper edge detecting section, said page data transfer starting unit, said page data transfer time measuring unit and said paper length counting number setting unit so as to transfer a desired image by exposure for each of said plurality of image forming sections and, when having received predetermined paper, controls said paper length counting number setting unit so as to set, when the page transfer starting unit has started transfer of page data to said plurality of image forming sections sequentially beginning with said upstream, sequentially counting numbers corresponding to said predetermined paper length to said page data transfer time measuring unit.

In the foregoing, a preferable mode is one wherein said page data transfer starting unit includes a delay time storing section to calculate, in advance, and to store individual delay time occurring between a receipt of said edge detecting signal and a start of exposure which is calculated from a carrying speed of said paper and a distance between said paper edge detecting section and said plurality of image forming sections in said paper carrying path.

Also, a preferable mode is one wherein said paper length counting number setting unit has a paper length counting number storing section.

According to a fifth aspect of the present invention, there is provided an image forming device comprising:

a plurality of image forming sections, each being arranged apart by a specified distance in a paper carrying direction of a paper carrying path;

a paper edge detecting section being placed nearer to an upstream side than each of said plurality of image forming sections in said carrying direction to detect a front edge of paper being carried on said paper carrying path and to output a front edge detecting signal and to detect a back edge of paper and to output a back edge detecting signal;

a page data transfer starting unit to start a transfer of page data after a lapse of each delay time occurring between a receipt of said end detecting signal and a start of exposure which is calculated from a carrying speed of said paper and a distance between said paper edge detecting section and said plurality of image forming sections in said paper carrying path;

a page data transfer time measuring unit to individually count page data transfer time for each of said plurality of image forming sections and to stop transfer of page data after completion of a predetermined number of counting;

a paper length counting number setting unit to set a number of counting corresponding to said paper length to a page data transfer time measuring unit;

a count number re-setting unit to reset a remaining number of counting during said page data transfer time measuring unit is individually counting page data transfer time; and a control section to control said paper edge detecting section, said page data transfer starting unit, said page data transfer time measuring unit and said paper length counting number setting unit, and said counting number resetting unit so as to transfer a desired image by exposure for each of said plurality of image forming sections and, when having received said back edge detecting signal during a period of time when said page data transfer time measuring unit is individually counting page data transfer data, controls said counting number resetting unit so as to reset remaining numbers of counting of said page data transfer time measuring unit corresponding to said plurality of image forming sections being arranged in order from an upstream to a downstream.

In the foregoing, a preferable mode is one wherein said control section, when having received said back edge detecting signal, controls said counting number resetting unit so as to reset a remaining number of counting of said page data transfer time measuring unit corresponding to a first image forming section being arranged in order from an upstream to a downstream in said transfer direction to a number of counting being equivalent to said delay time and, when said counting is terminated, sequentially resets said remaining number of counting corresponding to a subsequent image forming section to a number of counting being equivalent to time obtained by subtracting delay time of a subsequent image forming section from delay time of an image forming section existing one ahead.

According to a sixth aspect of the present invention, there is provided an image forming device comprising:

a judging unit to judge presence or absence of image data to be printed;

a medium carrying amount detecting unit to detect an amount of carry of a printing medium; and wherein, in a case where said medium carrying amount detecting unit has detected carry of a predetermined amount, said judging unit when judging that image data to be printed exists, continues printing operations and, when judging that no image data to be printed exists, stops printing operations and to advise that an error has occurred in a printing medium.

BRIEF DESCRIPTION OF THE DRAWINGS

The above and other objects, advantages and features of the present invention will be more apparent from the following description taken in conjunction with the accompanying drawings in which.

DESCRIPTION OF THE PREFERRED EMBODIMENTS

Best modes of carrying out the present invention will be described in further detail using various embodiments with reference to the accompanying drawings.

First Embodiment

Figure 1:
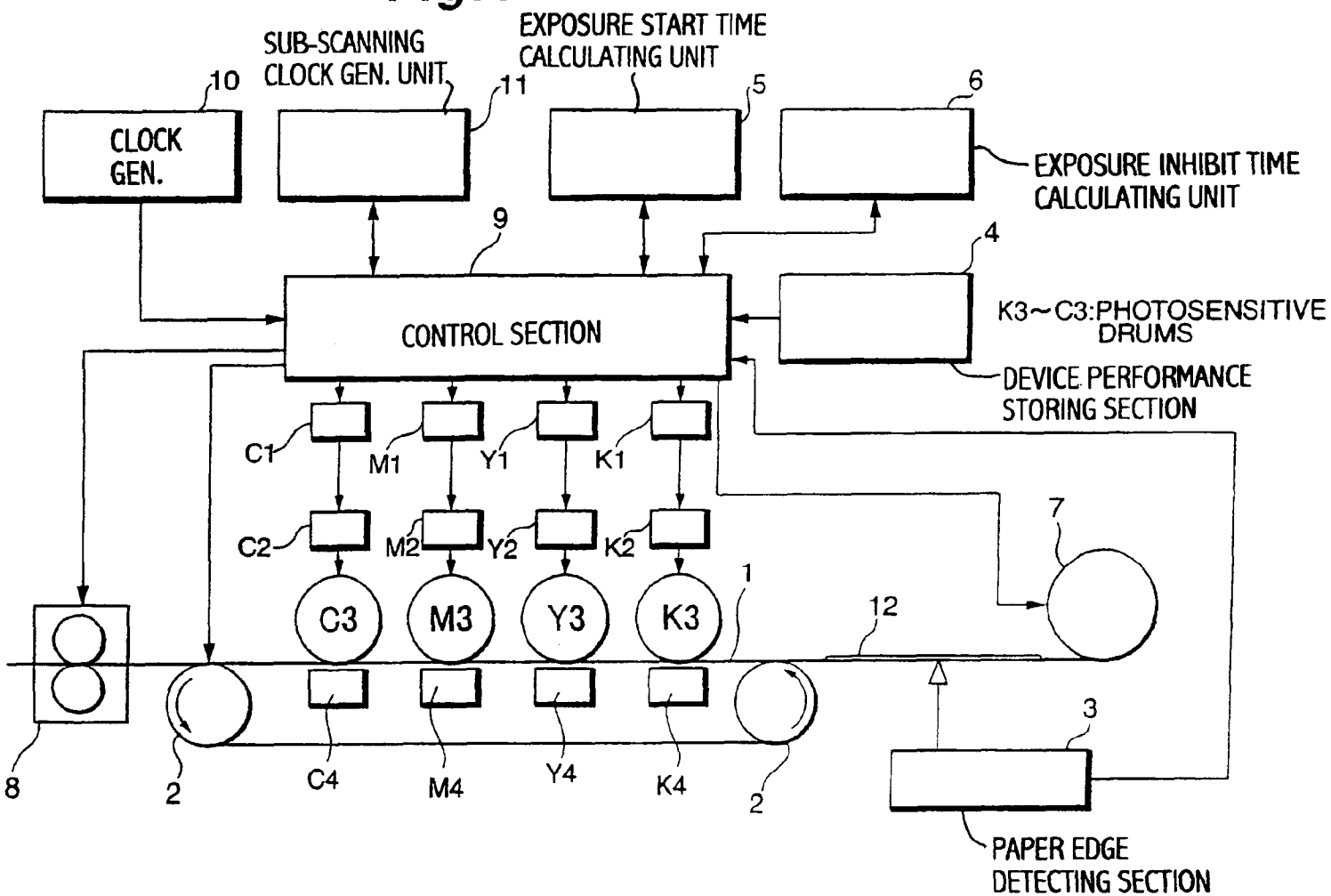
FIG. 1 is a schematic block diagram showing configurations of an image forming device according to a first embodiment of the present invention.

FIG. 1 is a schematic block diagram showing configurations of an image forming device according to a first embodiment of the present invention. The image forming device of the first embodiment as shown in FIG. 1 includes a carrying belt 1, a carrying roller 2, a paper edge detecting section 3, a device performance storing section 4, an exposure starting time calculating unit 5, an exposure inhibiting time calculating unit 6, a paper feeding roller 7, a fixing device 8, a control section 9, a clock generator 10, a sub-scanning clock generating unit 11, and LED controlling units K1, Y1, M1, and C1, exposure units K2, Y2, M2, and C2, photosensitive drums K3, Y3, M3, and C3, and transfer devices K4, Y4, M4, and C4.

The carrying belt 1 operates as a carrying path to carry a sheet of paper 12 at a predetermined carrying speed along which the photosensitive drums K3, Y3, M3, and C3 and the transfer device K4, Y4, M4, and C4, and a like are arranged at preset intervals. The carrying roller 2 is a unit used to drive the above carrying belt 1 at a predetermined carrying speed.

The paper edge detecting section 3 being placed on an upstream side of the plurality of photosensitive drums K3, Y3, M3, and C3 in a carrying direction of the above carrying belt 1 detects a top end of a sheet of paper 12 being carried on the above carrying belt 1 and outputs an end detecting signal and also detects a front edge of the sheet of paper being shorter than paper having a predetermined length and outputs an abnormal edge detecting signal.

The device performance storing section 4 is a portion in which data on device performance of the image forming device is stored. It stores, for example, all data required for controlling the image forming device including data on resolution of the image forming device, a carrying speed of the carrying belt, distances among the plurality of photosensitive drums K3, Y3, M3, and C3 being arranged along the carrying belt 1, distances between the plurality of photosensitive drums K3, Y3, M3, and C3 and the paper edge detecting section 3, diameters of the photosensitive drums K3, Y3, M3, and C3, a length of a sheet of predetermined paper scheduled to be used, and a like.

An exposure starting time calculating unit 5, when having received a paper edge detecting signal from the paper edge detecting section 3, calculates exposure starting time for each of a plurality of the above photosensitive drums from a carrying speed of the above sheet of paper 12 and on a distance between the paper edge detecting section 3 and each of the above photosensitive drums K3, Y3, M3, and C3.

Operations of the exposure start time calculating unit 5 are performed based on control of the control section 9 to be described later by using data being stored in the device performance storing section 4. By this exposure starting time calculating unit 5, a transfer position for an image to be transferred on the above sheet of paper 12 by a plurality of photosensitive drums K3, Y3, M3, and C3 can be exactly controlled. As a result, for example, in the case of a color image, no ooze in color occurs.

An exposure inhibiting time calculating unit 6, when having received an abnormal edge detecting signal from the paper edge detecting section 3, calculates exposure inhibiting time for each of a plurality of the above photosensitive drums from a carrying speed of the above sheet of paper 12 and on a distance between the paper edge detecting section 3 and each of the above photosensitive drums K3, Y3, M3, and C3.

Operations of the exposure inhibiting time calculating unit 6 is performed on control of the control section 9 by using data being stored in the above device performance device section 4. By being equipped with the exposure inhibiting time calculating unit 6, even if a sheet of paper being shorter than a given paper is inserted, no transfer of an image to a place outside of the paper 12 (a portion being shorter than preset paper), that is, to a carrying belt 1 occurs.

The paper feeding roller 7 is placed in the most upstream portion of the carrying belt 1 which is adapted to feed a sheet of paper 12 to a carrying belt 1. The fixing device 8 is placed in the most downstream of the carrying belt 1 which is adapted to fix a desired image having been transferred to the sheet of paper 12. Here, a plurality of images having been transferred to the sheet of paper 12 by a plurality of photosensitive drums K3, Y3, M3, and C3, a plurality of transfer devices K4, Y4, M4, and C4, or a like is collectively fixed.

The control section 9 controls the above paper edge detecting section 3, the above exposure start time calculating unit 5, and the above exposure inhibiting time calculating unit 6 so that a desired image is exposed and transferred for each of the plurality of photosensitive drums K3, Y3, M3, and C3 and, when having received a sheet of paper 12 having its length being shorter than its pre-set length, inhibits exposure on an image in a portion being not covered by a pre-set length of the paper 12. That is, the control section 9 is a CPU (Central Processing Unit) adapted to control all portions in the image forming device. The exposure start time calculating unit 5 and the exposure inhibiting time calculating unit 6 may be configured as a control program that operates the CPU. It is needless to say that these units 5 and 6 can be configured as an individual circuit. Moreover, a counter adapted to store a result calculated by these units as a counted number of sub-scanning clocks to be described later is internally provided.

The clock generator 10 is adapted to produce a clock signal as a reference for operations of the above control section 9. The sub-scanning clock generating unit 11 is used to produce a sub-scanning clock which enables fine line feeding that provides a line feeding interval being shorter than that for an image being transferred from an outside device. The sub-scanning clock generating unit 1 is a unit required for causing a plurality of images being transferred on a sheet of paper to be matched by using a plurality of photosensitive drums K3, Y3, M3, and C3, a plurality of transfer devices K4, Y4, M4, and C4, or likes. That is, it is used to produce a clock signal required for enabling a mechanical line feeding having an interval being shorter than that for resolution being stored in the above device performance device section 4.

The LED controlling units K1, Y1, M1, and C1 provide timing with which image data for one line is transferred and timing with which an image is transferred to the photosensitive drums K3, Y3, M3, and C3, in accordance with an instruction of the above control section and are used to control exposure units K2, Y2, M2, and C2. The LED controlling unit K1 is used to control a black image. The LED controlling unit Y1 is adapted to control a yellow image. The LED controlling unit M1 is adapted to control a magenta image. The LED controlling unit C1 is adapted to control a cyan image.

The exposure units K2, Y2, M2, and C2 are adapted to perform selective exposures on a desired image on the photosensitive drum to create an electrostatic latent image in accordance to control of the above LED controlling units K1, Y1, M1, and C1. In ordinary cases, an LED array is used. The exposure unit K2 is used to perform exposures on a black image. The exposure unit Y2 is used to perform exposure on a yellow image. The exposure unit M2 is used to perform exposure on a magenta image. The exposure unit C2 is used to perform exposures on a cyan image.

Each of surfaces of the photosensitive drums K3, Y3, M3, and C3 is uniformly charged with charges by a charger (not shown) and a desired image is exposed on the charged surface by selective exposures using the above charger to produce an electrostatic latent image. The electrostatic latent image is developed by the developer (not shown) and is transferred to a sheet of paper 12 by transfer devices K4, Y4, M4, and C4.

The photosensitive drum K3 is used to produce an electrostatic latent image of a black image. The photosensitive drum Y3 is used to produce an electrostatic latent image of a yellow image. The photosensitive drum M3 is used to produce an electrostatic latent image of a magenta image. The photosensitive drum C3 is used to produce an electrostatic latent image of a cyan image.

The photosensitive drums K3, Y3, M3, and C3 are placed apart from one another by a distance being predetermined for each of the drums in a carrying direction on the carrying belt 1. They are arranged in order of the photosensitive drum K, Y, and C beginning with an upstream in the carrying direction. Moreover, the photosensitive drum K3 operates together with the above LED controlling unit K1 and the exposure device K2 in an integral manner. Similarly, the photosensitive drum Y3 operates the above LED controlling unit Y1 and exposure device Y2. The photosensitive drum M3 operates together with the above LED controlling unit M1 and the exposure device M2 in an integral manner. The photosensitive drum C3 operates together with the above LED controlling unit C1 and the exposure device C2 also in an integral manner.

The transfer devices K4, Y4, M4, and C4 are used to transfer toner being adhered to an electrostatic latent image of the above photosensitive drum to the sheet of paper 12. The transfer device K4 is used to transfer toner from the photosensitive drum K3 to the paper 12. The transfer device Y4 is used to transfer toner to the paper 12 from the photosensitive drum Y3. The transfer device M4 is used to transfer toner to the paper 12 beginning with the photosensitive drum M3. The transfer device C4 is used to transfer toner to the paper 12 from the photosensitive drum C3.

Figure 2:
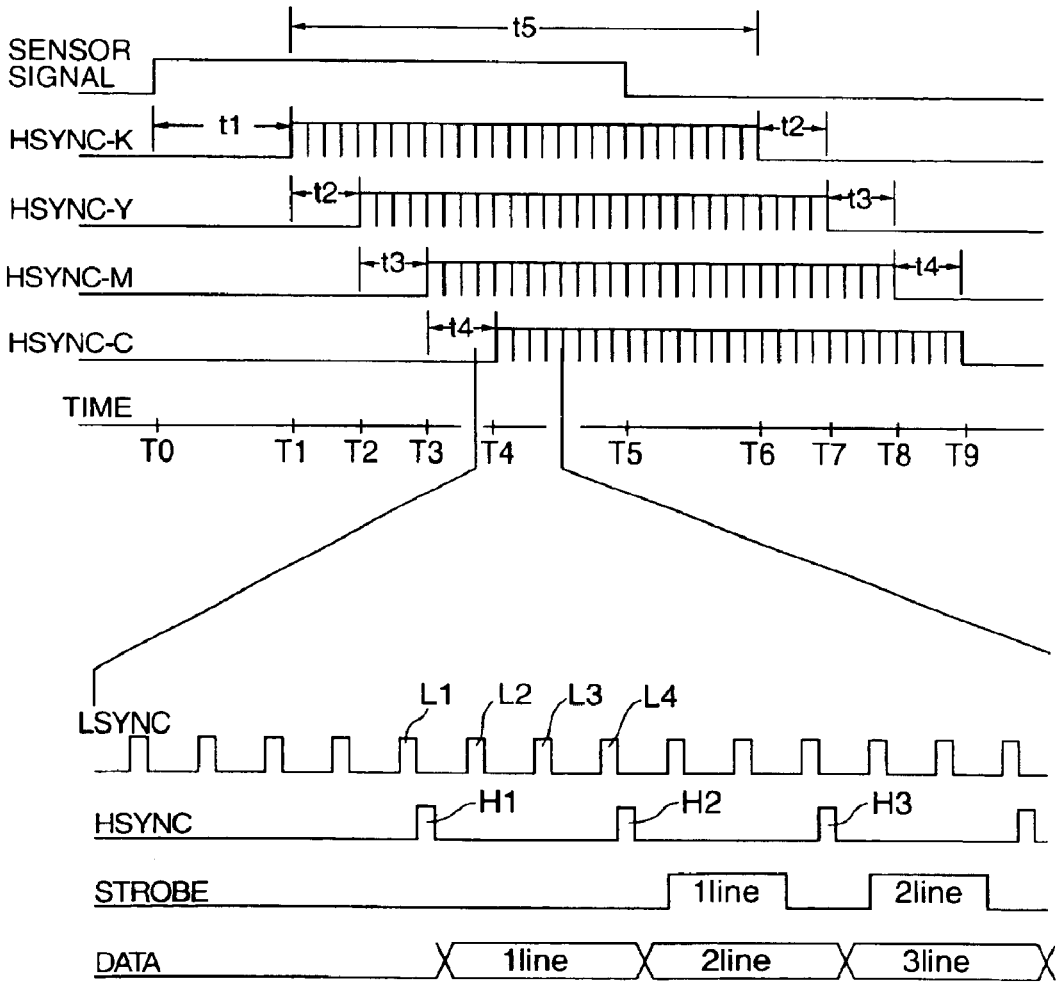
FIG. 2 is a time chart (No. 1) explaining operations of the image forming device according to the first embodiment of the present invention.

Operations of the embodiment 1 are described. First, operations of the exposure start time calculating 5 are chiefly described. FIG. 2 is a time chart (No. 1) explaining operations of an image forming device according to the first embodiment of the present invention. A sensor signal, HSYNC-K, HSTNC-Y, HSYNC-M, and HSYNC-C, and time are sequentially plotted as ordinate from its top and a lapse of time is plotted as abscissa. Moreover, a diagram is provided in which the signal HSTNC-C is expanded as a sample and in which a sensor signal, LSYNC, HSYNC, STROBE, and DATA are plotted as ordinate and a lapse of time is plotted as abscissa. Operations, at time T0 to T9 as shown in FIG. 2, of the image forming device (mainly of the exposure start time calculating unit) of the first embodiment are described by using FIG. 1.

(At Time T0)

The paper edge detecting section 3 having detected reach of an edge of the paper 12 inserted from the paper feeding roller 7 to the paper edge detecting section 3 feeds an edge detecting signal to the control section 9. The exposure start time calculating section 5, based on control of the control section 9, calculates the exposure starting time and exposure terminating time from a carrying speed of the paper 12 and a distance between the edge detecting section 3 on the carrying belt 1 and each of the photosensitive drums K3, Y3, M3, and C3 for each of a plurality of the above photosensitive drum.

At this time, the exposure starting time T1 of the photosensitive drum K3 can be obtained by adding a value t1 being a result from division of a difference between a distance between the paper detecting section 3 and the photosensitive drum K3 and a distance of circumference from a recording position (placing position of the exposure device) and a transferred position (placing position of the transfer device K4) by a carrying speed, to time T0. Moreover, the exposure terminating time T6 can be obtained by adding the carrying time t5 for a sheet of paper having a predetermined length to the exposure starting time T1.

The exposure starting time T2 of the photosensitive drum Y3 can be obtained by adding a value t2 being a result from division of a distance between the photosensitive drum K3 and the photosensitive drum Y3 on the carrying belt, to time T1 by a carrying speed. Moreover, the exposure starting time T3 of the photosensitive drum M3 can be obtained by adding a value t3 being a result from division of a distance between the photosensitive drums Y3 and M3 on the carrying belt, to time T1 by a carrying speed. Similarly, the exposure starting time T4 of the photosensitive drum C3 can be obtained by adding a value t4 being a result from division of a distance between the photosensitive drum M3 and the photosensitive drum C3 on the carrying belt, to time T3, by a carrying speed.

Moreover, exposure terminating time T7, T8, and T9 of the photosensitive drums Y3, M3, and C3, in a same manner as in the photosensitive drum K3 can be obtained by adding carrying time t5 to the exposure starting time T2, T3, and T4. Each of results from the above calculation can be set, as a counted number, to the counter being provided in the control section 9.

(Time T1)

The control section 9 transmits a timing signal HSYNC-K to the LED controlling unit K1 based on a result of the exposure start time calculating unit 5. The LED controlling unit K1 starts producing an electrostatic latent image of a black image on a charging surface of the photosensitive drum K3 by controlling the exposure device K2.

(Time T2)

The control section 9 transmits a timing signal HSYNC-Y, based on a result of calculation of the exposure start time calculating section 5, to the LED controlling unit Y1. The LED controlling unit Y1 controls the exposure device Y2 to start producing an electrostatic latent image of a yellow image on a charging face of the photosensitive drum Y3.

(Time T3)

The control section 9 transmits a timing signal HSYNC-M, based on a result of calculation of the exposure start time calculating section 5, to the LED controlling unit M1. The LED controlling unit M1 controls the exposure device M2 to start producing an electrostatic latent image of a magenta image on a charging face of the photosensitive drum M3.

(Time T4)

The control section 9 transmits a timing signal HSYNC-C, based on a result of calculation of the exposure start time calculating section 5, to the LED controlling unit C1. The LED controlling unit C1 controls the exposure device C2 to start producing an electrostatic latent image of a magenta image on a charging face of the photosensitive drum C3.

(Time T5)

The edge of the sheet of paper 12 inserted into the paper feeding roller 7 passes through the paper edge detecting section 3. Since a sheet of pre-set paper has passed through the paper edge detecting section 3 at scheduled time, an abnormal edge detecting signal is not output.

(Time T6)

The control section 9, based on a result from the above calculation of the exposure inhibiting time calculating unit 6, stops transmitting a transfer timing signal HSYNC-K to the LED controlling unit K1. The LED controlling unit K1 controls the exposure device K2 to stop producing an electrostatic latent image of a black image on a charging surface of the photosensitive drum K3.

(Time T7)

The control section 9, based on a result from the above calculation of the exposure inhibiting time calculating unit 6, stops transmitting a transfer timing signal HSYNC-Y to the LED controlling unit Y1. The LED controlling unit Y1 controls the exposure device Y2 to stop producing an electrostatic latent image of a yellow image on a charging surface of the photosensitive drum Y3.

(Time T8)

The control section 9, based on a result from the above calculation of the exposure start time calculating unit 5, stops transmitting a transfer timing signal HSYNC-M to the LED controlling unit M1. The LED controlling unit M1 controls the exposure device M2 to stop producing an electrostatic latent image of a magenta image on a charging surface of the photosensitive drum M3.

(Time T9)

The control section 9, based on a result from the above calculation of the exposure start time calculation, stops transmitting a transfer timing signal HSYNC-C to the LED controlling unit C1. The LED controlling unit C1 controls the exposure device C2 to stop producing an electrostatic latent image of a cyan image on a charging surface of the photosensitive drum C3.

Next, by using the case of the signal HSYNC-C as an example, relations among the LSYNC (sub-scanning clock signal), the HSYNC (transferring timing signal), and the DATA (data) are described.

As shown in FIG. 2, a repetition cycle of the signal LSYNC (sub-scanning clock signal), as one example, is reduced to one third of a repetition cycle of the signal HSYNC (transfer timing signal). By operating as above, a positional deviation in an image produced by each of a plurality of photosensitive drums on the sheet of paper 12 is reduced within one thirds of a line feeding interval of the HSTNC (transfer timing signal).

Moreover, as shown in FIG. 2, one line of DATA (data) is transferred to the exposure device, a STROBE (strobe signal) is applied, with a little delay, to the exposure device and an electrostatic image is produced.

Next, since operations in which paper having a predetermined length is used have been described above, operations are described in which a sheet of the paper having a length being shorter than a predetermined length of the paper is used.

Figure 3:
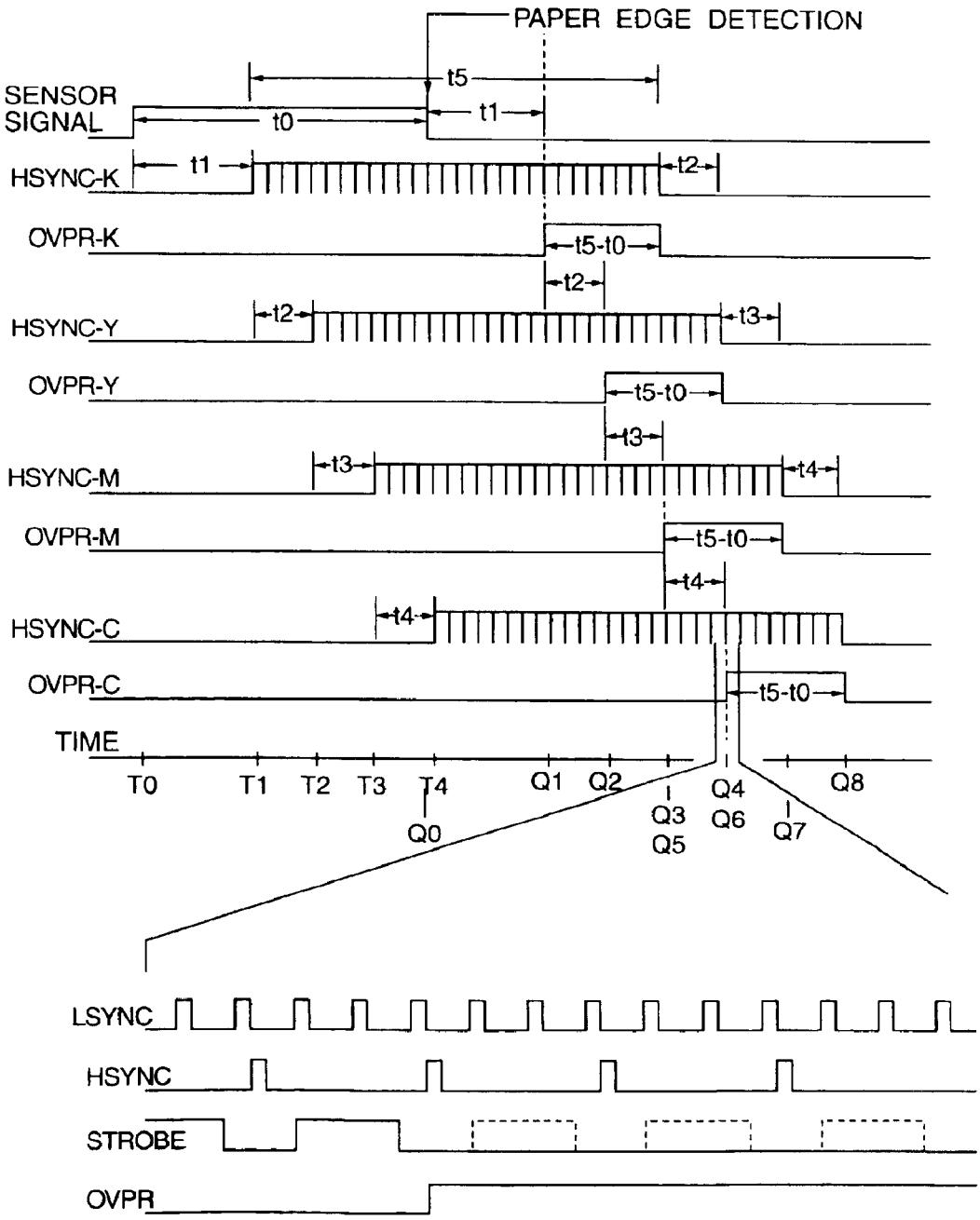
FIG. 3 is a time chart (No. 2) explaining operations of the image forming device according to the first embodiment of the present invention.

FIG. 3 is a time chart (No. 2) explaining operations of the image forming device according to the first embodiment of the present invention. A sensor signal, HSYNC-K, HSTNC-Y, HSYNC-M, and HSYNC-C, and time are sequentially plotted as ordinate beginning with its top and a lapse of time is plotted as abscissa. Moreover, a diagram is provided in which a signal HSYNC-C is partially expanded as a sample and in which LSYNC, HSYNC, STROBE, and OVPR are plotted as ordinate and a lapse of time is plotted as abscissa. Operations, at time T0 to Q8 as shown in FIG. 3, of the image forming device (mainly operations of the exposure inhibiting time calculating unit 6) of the first embodiment are described by using FIG. 1.

(Time T0 to T4)

Since operations of the exposure start time calculating unit 5 at the time T0 to T4 are entirely same as those at the time T0 to T4, descriptions are omitted accordingly.

(Time Q0)

Let it be assumed that a sheet of paper has passed earlier by time (t5 to t0) through the paper edge detecting section 3 at time Q0 by time to past the time T0 when the edge detecting signal was output. At this time, the paper edge detecting section 3 transmits an abnormal edge detecting signal to the control section 9. The exposure inhibiting time calculating unit 6, based on control of the control section 9, calculates a carrying speed, an exposure inhibiting time for each of the plurality of photosensitive drums from each distance between the paper edge detecting section 3 and each of the above photosensitive drums K3, Y3, M3, and C3 and time when the exposure inhibition is cancelled are calculated.

The exposure inhibiting time Q1 of the photosensitive drum K3 can be obtained by adding a value t1 being a result from division of a difference between a distance between the paper detecting section 3 and the photosensitive drum K3 on the carrying belt and a distance of circumference from a recording position (placing position of the exposure device K4) and a transferring position (placing position of the transfer device K4) by a carrying speed, to time TQ. Moreover, time Q5 when the exposure inhibition are cancelled are calculated by adding time (t5 to t10) to the exposure inhibiting time Q1.

The exposure inhibiting time Q2 of the photosensitive drum Y3 can be obtained by adding a value t2 being a result from division of a distance between the photosensitive drum K3 and the photosensitive drum Y3 on the carrying belt 1, by a carrying speed, to the time Q1. Moreover, the exposure starting time Q3 of the photosensitive drum Y3 can be obtained by adding a value t3 being a result from division of a distance between the photosensitive drum Y3 and the photosensitive drum M3 on the carrying belt 1 by a carrying speed, to the time Q2. Similarly, the exposure starting time Q4 of the photosensitive drum C3 can be obtained by adding a value t4 being a result from division of a distance between the photosensitive drum M3 and the photosensitive drum C3 on the carrying belt 1 by a carrying speed, to the time Q3.

Moreover, time Q6, Q7, and Q8 to cancel exposure inhibition of the photosensitive drums Y3, M3, and C3 can be obtained by adding the exposure terminating time to the time (t5–t0) in the same manner as in the case of the above photosensitive drum K3. Each of results from the above calculation is set, as a counted number of the sub-scanning clocks, to each of the counters being provided in the control section 9.

(Time Q1)

The control section 9, based on a result from the above calculation of the exposure inhibiting time calculating unit 6, transmits an exposure inhibiting signal OVPR-K to the LED controlling unit K. The LED controlling unit K1 controls the exposure device K2 to stop exposure to the photosensitive drum K3.

(Time Q2)

The control section 9, based on a result from the above calculation of the exposure inhibiting time calculating unit 6, transmits an exposure inhibiting signal OVPR-Y to the LED controlling unit Y1. The LED controlling unit Y1 controls the exposure device Y2 to stop exposure to the photosensitive drum Y3.

(Time Q3)

The control section 9, based on a result from the above calculation of the exposure inhibiting time calculating unit 6, transmits an exposure inhibiting signal OVPR-M to the LED controlling unit M1. The LED controlling unit M1 controls the exposure device K2 to stop exposure to the photosensitive drum M3.

(Time Q4)

The control section 9, based on a result from the above calculation of the exposure inhibiting time calculating unit 6, transmits an exposure inhibiting signal OVPR-C to the LED controlling unit C1. The LED controlling unit C1 controls the exposure device C2 to stop exposure to the photosensitive drum C3.

(Time Q5)

The control section 9, based on a result from the above calculation of the exposure inhibiting time calculating unit 6, transmits an exposure inhibiting signal OVPR-K to the LED controlling unit K1.

(Time Q6)

The control section 9, based on a result from the above calculation of the exposure inhibiting time calculating unit 6, transmits an exposure inhibiting signal OVPR-Y to the LED controlling unit Y1.

(Time Q7)

The control section 9, based on a result from the above calculation of the exposure inhibiting time calculating unit 6, transmits an exposure inhibiting signal OVPR-M to the LED controlling unit M1.

(Time Q8)

The control section 9, based on a result from the above calculation of the exposure inhibiting time calculating unit 6, transmits an exposure inhibiting signal OVPR-C to the LED controlling unit C1.

Next, by using the case of the signal HSYNC-C as an example, relations among the LSYNC (sub-scanning clock signal), HSYNC (transferring timing signal), STROBE (strobe signal), and OVPR (exposure inhibiting signal) are described.

As shown in FIG. 3, a repetition cycle of the signal LSYNC (sub-scanning clock signal), as one example, is reduced to one third of a repetition cycle of the signal HSYNC (transfer timing signal). By operating as above, a positional deviation in an image produced by each of a plurality of photosensitive drums on the sheet of paper 12 is reduced within one thirds of a line feeding interval of the HSYNC (transfer timing signal). Moreover, when the OVPR (exposure inhibiting signal) is being output, the STROBE (strobe signal) is not stopped and an electrostatic latent image is not produced.

In the above description, though the carrying belt is used as a carrying device, a carrying roller made up of plural pairs of rollers also may be used.

As described above, by being provided with a plurality of the photosensitive drums, paper edge detecting section, exposure start time calculating unit, exposure inhibiting time calculating unit, control section, the tandem-type image forming device can be realized by using only one paper edge detecting sensor and one detecting circuit. Moreover, even when paper being shorter than that required originally for printing is inserted, an image is not transferred to a place being outside the paper, that is, to a carrying belt, a carrying unit such as a carrying roller, or a like. As a result, neither the carrying belt is made dirty, nor toner is wastefully consumed.

Second Embodiment

Figure 4:
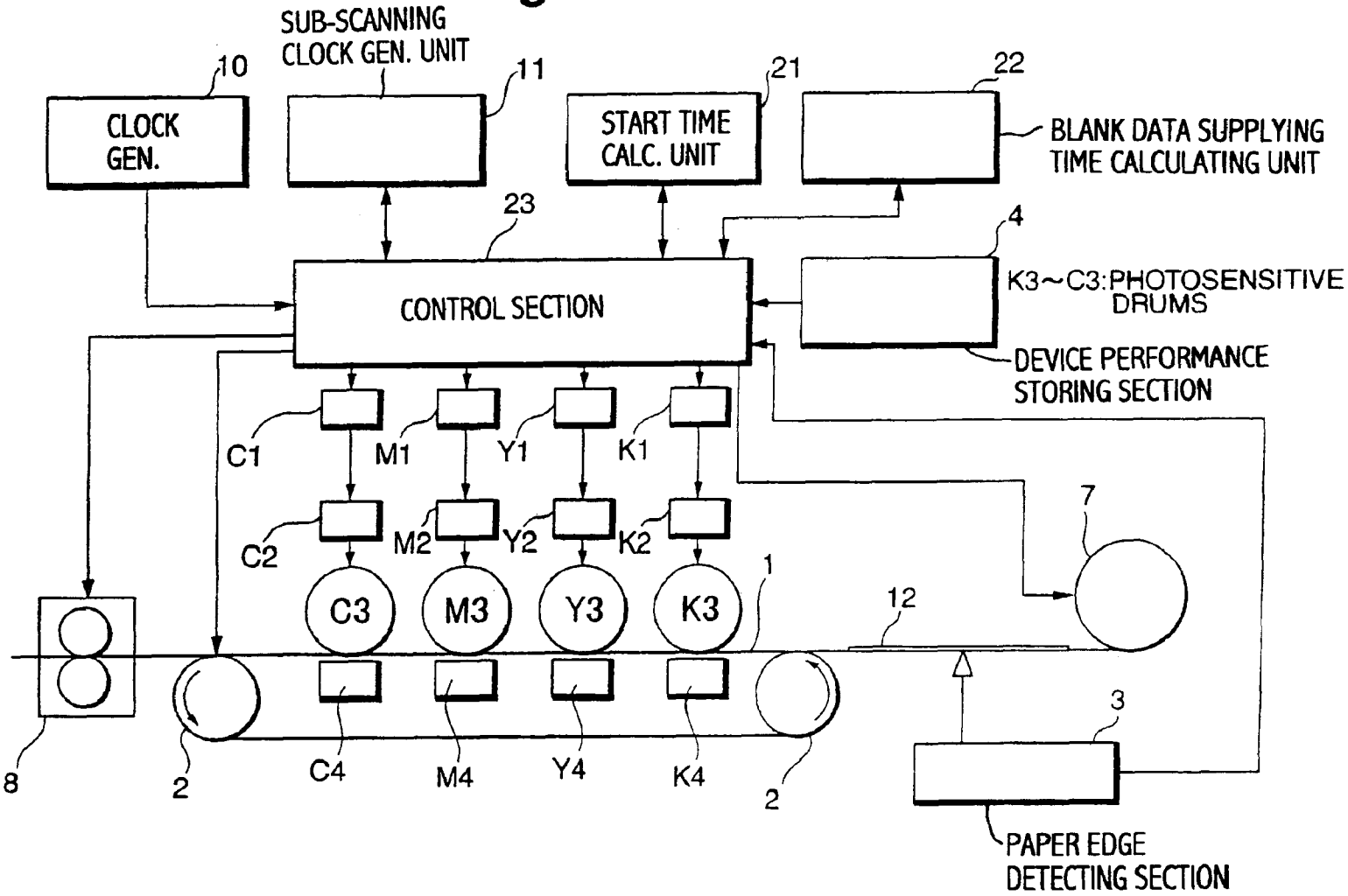
FIG. 4 is a schematic block diagram showing configurations of an image forming device according to a second embodiment of the present invention.

FIG. 4 is a schematic block diagram showing configurations of an image forming device according to a second embodiment of the present invention. The image forming device of the second embodiment as shown in FIG. 4 includes a carrying belt 1, a carrying roller 2, a paper edge detecting section 3, a device performance storing section 4, a paper feeding roller 7, a fixing device, a clock generator 10, a sub-scanning clock generating unit 11, an image data feeding supply start time calculating unit 21, a blank data supplying time calculating unit 22, a control section 23, LED controlling units K1, Y1, M1, and C1, exposure devices K2, Y2, M2, and C2, photosensitive drums K3, Y3, M3, and C3, and transfer devices K4, Y4, M4, and C4.

Only configurations of the image forming device of the second embodiment of the present invention being different from the first embodiment will be described. The image data supplying start time calculating unit 21, when having received an edge detecting signal from the above paper edge detecting section 3, calculates image data feeding start time for each of the above plurality of photosensitive drums and image data feeding terminating time from a carrying speed at which the above paper 12 is carried and a distance between the above paper edge detecting section 3 and each of the above photosensitive drums K3, Y3, M3, and C3 on the carrying belt 1.

The blank data supplying time calculating unit 22, when having received an abnormal edge detecting signal, calculates blank data supplying terminating time from a carrying speed of the above paper 12, supplying start time for feeding blank data to each of the plurality of photosensitive drums obtained from a distance between the paper edge detecting section 3 and each of the photosensitive drums C3, M3, Y3, and K3 on the carrying belt 1, and a predetermined length of the paper 12.

The control section 23 controls the above paper edge detecting section 3, the above image data feeding time calculating unit 21, and the above blank data supplying time calculating unit 22 so that a desired image is transferred by exposure for each of the plurality of photosensitive drums K3, Y3, M3, and C3 and is transferred and, when having received a sheet of paper 12 having its length being shorter than its predetermined length, blank data is exposed and transferred to a portion being not covered by the predetermined length of the paper 12.

That is, the control section 23 is a CPU adapted to control all portions in the image forming device. The image data feeding start time calculating unit 21 or the blank data supplying time calculating unit 22 may be configured as a control program to operate the CPU. It is needless to say that each of these units may be configured as an individual circuit. Moreover, a counter adapted to store a result from calculation by these units as a counted number of sub-scanning clocks to be described later is internally provided. Since operations of other components are entirely same as those in the first embodiment, descriptions are omitted accordingly.

In the second embodiment, instead of the exposure start time calculating unit 5 of the first embodiment, the image data feeding start time calculating unit 21 is provided, and instead of the exposure inhibiting time calculating unit 6 of the first embodiment, the blank data supplying time calculating unit 22 is provided. That is, in the first embodiment, when a sheet of paper 12 having a length being shorter than its predetermined length, the exposure is inhibited on a surface of the photosensitive drum being equivalent to a portion being not covered by a predetermined length of the paper 12. In this embodiment, blank data is transferred by exposure in a portion being not covered by a predetermined length of the paper 12. Hereinafter, these operations are described.

Figure 5:
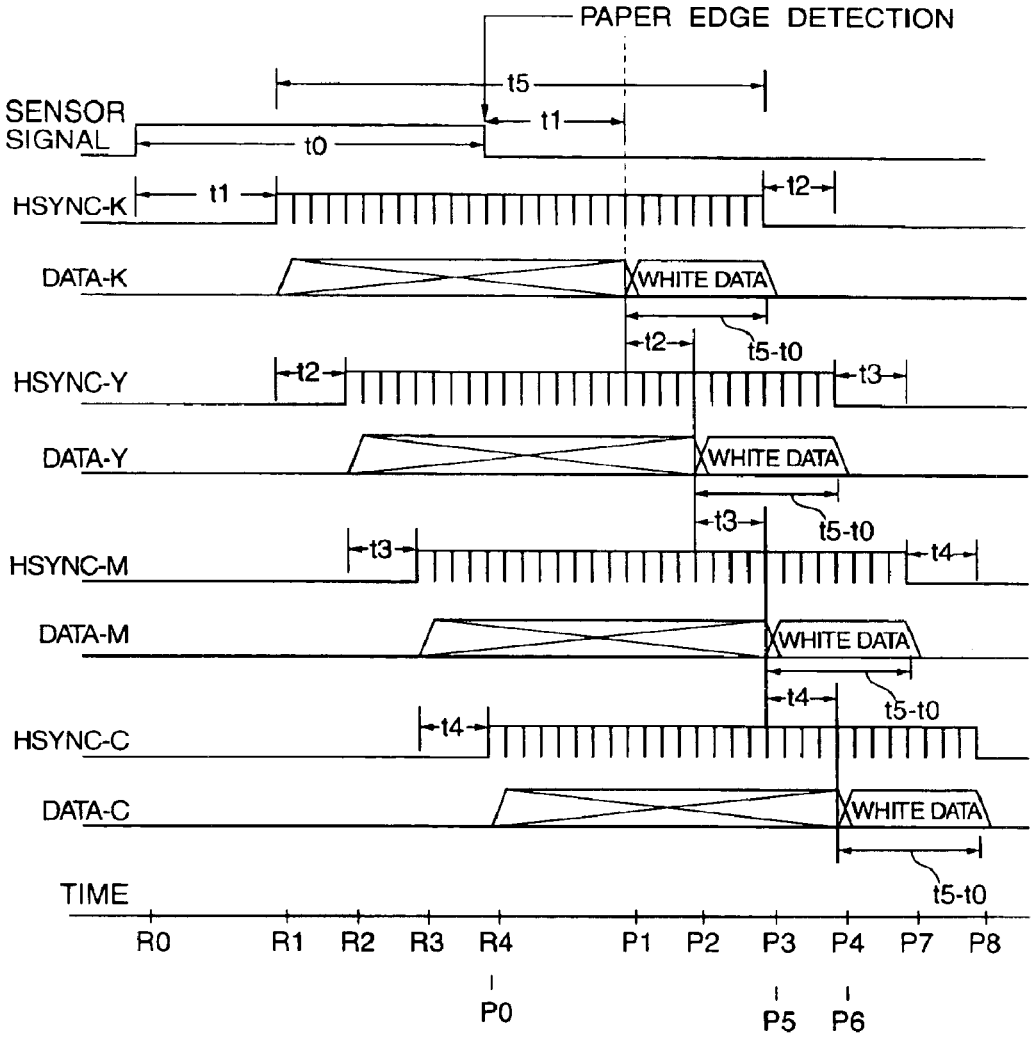
FIG. 5 is a time chart explaining operations of the image forming device according to the second embodiment of the present invention.

FIG. 5 is a time chart explaining operations of an image forming device according to the second embodiment of the present invention. A sensor signal, HSYNC-K, DATA-K, HSYNC-Y, DATA-Y, HSYNC-M, DATA-M, HSYNC-C, DATA-C, and time are sequentially plotted as ordinate beginning with its top and a lapse of time is plotted as abscissa. Operations, at time R0 to P8 as shown in FIG. 5, of the image forming device of the first embodiment are described by using FIG. 4.

(Time R0)

The paper edge detecting section 3 having detected reach of an edge of the paper 12 inserted from the paper feeding roller 7 to the edge detecting section 3 transmits an edge detecting signal to the control section 23. The image data feeding start time calculating unit 21, based on control by the control section 23, calculates image data feeding start time and image data feeding terminating time for each of the plurality of photosensitive drums from a carrying speed of the paper 12 and a distance between the paper edge detecting section 3 and each of the photosensitive drums K3, Y3, M3, and C3 on the carrying belt 1.

At this time, the image data feeding start time R1 to the photosensitive drum K3 can be obtained by adding a value t1 being a result from division of a difference between a distance between the paper detecting section 3 and the photosensitive drum K3 and a distance of circumference from a recording position (placing position of the exposure device) and a transferred position (placing position of the transfer device K4) by a carrying speed, to time R0. Moreover, the image data feeding terminating time can be obtained by adding the carrying time t5 for a sheet of paper having a predetermined length to the image data feeding start time R1.

The image data feeding start time IMAGE DATA FEEDING to the photosensitive drum Y3 can be obtained by adding a value t2 being a result of division of a distance between the photosensitive drum K3 and photosensitive drum Y3 by a carrying time to time R1. Moreover, the image data feeding start time R3 to the photosensitive drum M3 can be obtained by adding a value t2 being a result of division of a distance between the photosensitive drum K3 and photosensitive drum Y3 by a carrying time, to time R1. Similarly, the image data feeding start time R4 to the photosensitive drum M3 can be obtained by adding a value t4 being a result of division of a distance between the photosensitive drum M3 and photosensitive drum C3 by a carrying time, to time R3.

Moreover, the image data feeding terminating time of the photosensitive drums Y3, M3, and C3, in the same way as for the photosensitive drum K3, can be obtained by adding a carrying time t5 of the paper 12 having a predetermined length to the image data feeding start time R2, R3, and R4. Each of results from the above calculation is set, as a counted number of the sub-scanning clocks, to each of the counters being provided in the control section 23.

(Time R1)

The control section 23, based on a result from the above calculation of the image data feeding start time calculating unit 21, transmits image data (black signal), together with a transfer timing signal HSYNC-K, to the LED controlling unit K1. The LED controlling unit K1 controls the exposure device K2 to start producing an electrostatic latent image of a black image on a charging surface of the photosensitive drum K3.

(Time R2)

The control section 23, based on a result from the calculation of the image data feeding start time calculating unit 21, transmits, together with a transfer timing signal HSYNC-Y, image data (yellow signal) to the LED controlling unit Y1. The LED controlling unit Y1 controls the exposure device Y2 to start producing an electrostatic latent image of a yellow image on a charging face of the photosensitive drum Y3.

(Time R3)

The control section 23, based on a result from the calculation of the image data feeding start time calculating unit 21, transmits, together with a transfer timing signal HSYNC-M, image data (magenta signal) to the LED controlling unit Y1. The LED controlling unit M1 controls the exposure device M2 to start producing an electrostatic latent image of a magenta image on a charging face of the photosensitive drum M3.

(Time R4)

The control section 23, based on a result from the calculation of the image data feeding start time calculating unit 21, transmits, together with a transfer timing signal HSYNC-C, image data (cyan signal) to the LED controlling unit C1. The LED controlling unit C1 controls the exposure device C2 to start producing an electrostatic latent image of a cyan image on a charging face of the photosensitive drum C3.

(Time P0)

Let it be assumed that a sheet of paper has passed earlier by time (t5 to t0) through the paper edge detecting section 3 at time Q0 by time t0 past the time R0 when the edge detecting signal was output. At this time, the paper edge detecting section 3 transmits an abnormal edge detecting signal to the control section 23. The blank data feeding time calculating unit 22, based on control of the control section 23, calculates blank data feeding start time and blank data feeding terminating time from a carrying speed of the paper 12, a distance between the paper edge detecting section 3 and each of the above photosensitive drums K3, Y3, M3, and C3, and a predetermined length of the paper, for each of the plurality of photosensitive drums.

The blank data feeding start time P1 of the photosensitive drum K3 can be obtained by adding a value t1 being a result from division of a difference between a distance between the paper detecting section 3 and the photosensitive drum K3 on the carrying belt and a distance of circumference from a recording position (placing position of the exposure device K4) and a transferring position (placing position of the transfer device K4) by a carrying speed, to time P0. Moreover, the blank data feeding terminating time P5 can be obtained by adding time (t5–t0) to the blank data feeding start time P1.

The blank data feeding start time P2 of the photosensitive drum Y3 can be obtained by adding a value t2 being a result from division of a distance between the photosensitive drum K3 and the photosensitive drum Y3 on the carrying belt 1, to the time P1. Moreover, the blank data feeding start time P3 of the photosensitive drum M3 can be obtained by adding a value t3 being a result from division of a distance between the photosensitive drum Y3 and the photosensitive drum M3 on the carrying belt 1, to the time P1. Similarly, the blank data feeding start time P4 of the photosensitive drum C3 can be obtained by adding a value t4 being a result from division of a distance between the photosensitive drum M3 and the photosensitive drum C3 on the carrying belt 1, to the time P3.

Moreover, time P6, P7, and P8 when feeding of blank data to the photosensitive drums Y3, M3, and C3 to the photosensitive drum Y3, M3, and C3 can be obtained by adding time (t5 to t0) to the exposure inhibiting time in the same manner as in the above photosensitive drum K3. Each of results from the above calculation is set, as a counted number of the sub-scanning clocks, to each of the counters being provided in the control section 23.

(Time P1)

The control section 23, based on a result from the above calculation of the blank data feeding time calculating unit 22, instead of image data, transmits blank data to the LED controlling unit K1. The LED controlling unit K1 controls the exposure device K2 to transfer blank data by exposure to the photosensitive drum K3.

(Time P2)

The control section 23, based on a result from the above calculation of the blank data feeding time calculating unit 22, instead of image data, transmits blank data to the LED controlling unit Y1. The LED controlling unit Y1 controls the exposure device Y2 to transfer blank data by exposure to the photosensitive drum Y3.

(Time P3)

The control section 23, based on a result from the above calculation of the blank data feeding time calculating unit 22, instead of image data, transmits blank data to the LED controlling unit M1. The LED controlling unit M1 controls the exposure device M2 to transfer blank data by exposure to the photosensitive drum M3.

(Time P4)

The control section 23, based on a result from the above calculation of the blank data feeding time calculating unit 22, instead of image data, transmits blank data to the LED controlling unit C1. The LED controlling unit Y1 controls the exposure device C2 to transfer blank data by exposure to the photosensitive drum C3.

(Time P5)

The control section 23, based on a result from the above calculation of the blank data feeding time calculating unit 22, terminates transmission of the blank data to the LED controlling unit K1.

(Time P6)

The control section 23, based on a result from the above calculation of the blank data feeding time calculating unit 22, terminates transmission of the blank data to the LED controlling unit Y1.

(Time P7)

The control section 23, based on a result from the above calculation of the blank data feeding time calculating unit 22, terminates transmission of the blank data to the LED controlling unit M1.

(Time P8)

The control section 23, based on a result from the above calculation of the blank data feeding time calculating unit 22, terminates transmission of the blank data to the LED controlling unit C1.

Effects of Second Embodiment

As described above, in the second embodiment, instead of the exposure start time calculating unit 5 (FIG. 1), the image data feeding start time calculating unit 21 is provided and, instead of the exposure inhibiting time calculating unit 6 (FIG. 1), the blank data feeding time calculating unit 22 is provided. Thus, when a sheet of paper 12 having its length being shorter than its predetermined length, the blank data is transferred by exposure to a surface of the photosensitive drum being equivalent to a portion being not covered by a predetermined length of the paper 12.

As a result, no image is not transferred to a place being outside the paper, no carrying belt is not made dirty, and no toner is consumed wastefully.

Third Embodiment

Figure 6:
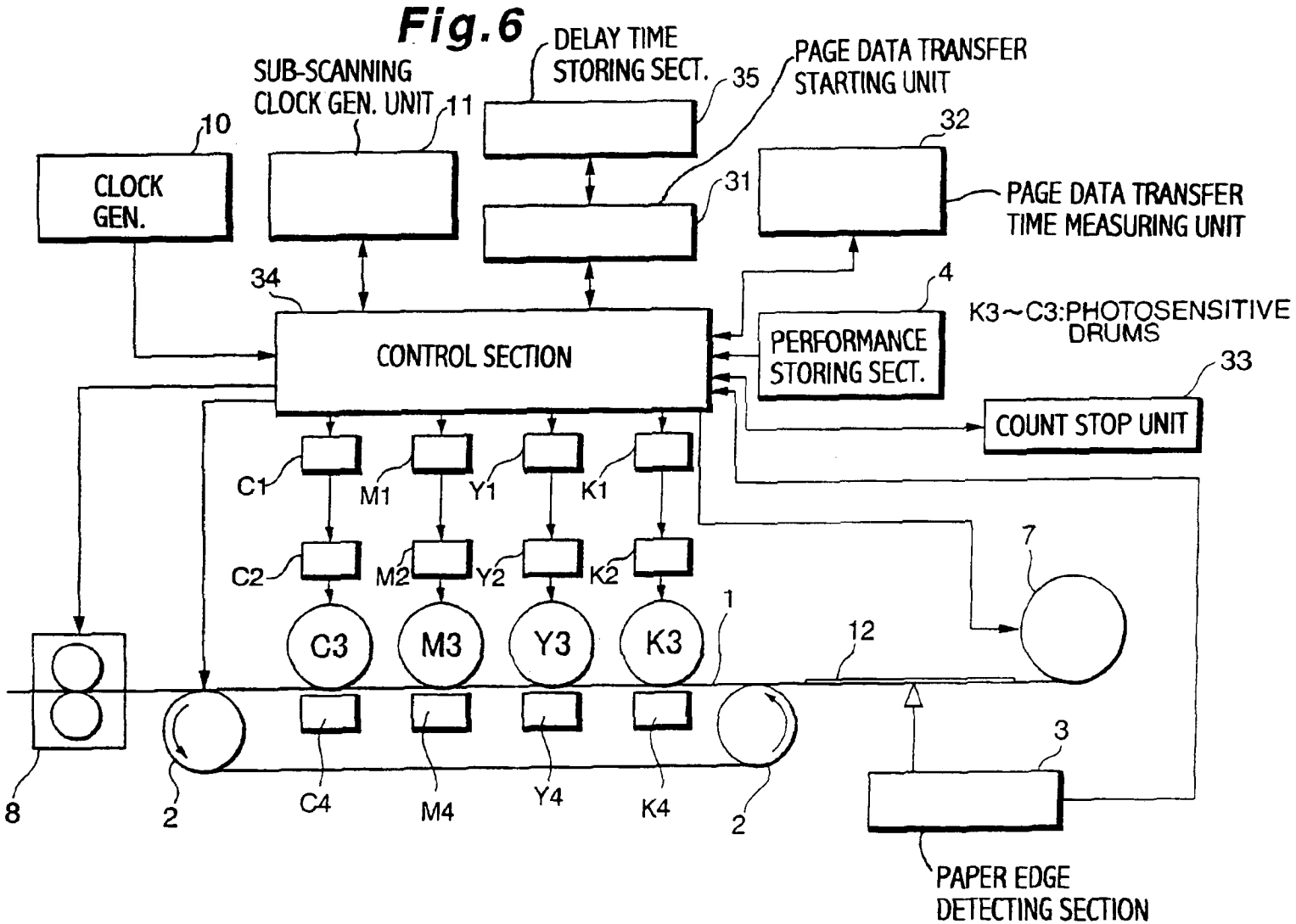
FIG. 6 is a schematic block diagram showing configurations of an image forming device according to a third embodiment of the present invention.

FIG. 6 is a schematic block diagram showing configurations of an image forming device according to a third embodiment of the present invention. The image forming device of the third embodiment as shown in FIG. 3 includes a carrying belt 1, a carrying roller 2, a paper edge detecting section 3, a device performance storing section 4, a fixing device 8, a clock generator 10, a sub-scanning clock generating unit 11, a page data transfer starting unit 31, a page data transfer time measuring unit 32, a count stopping unit 33, a control section 34, a delay time storing section 35, LED controlling units K1, Y1, M1, and C1, exposure devices K2, Y2, M2, and C2, photosensitive drums K3, Y3, M3, and C3, and transfer devices K4, Y4, M4, and C4.

Only configurations of the image forming device of the third embodiment of the present invention being different from the first embodiment will be described. Moreover, in the first and second embodiments, the present invention is explained in detail from a viewpoint of start and stop of exposures. However, in the third embodiment, the present invention is described from a viewpoint of start and stop of transferring page data (image data). The start and stop of transferring page data (image data) have a close relation with those of exposures.

The page data transfer starting unit 31 starts transferring page data (image data) after a lapse of a delay time obtained by calculation of a carrying speed occurring before exposure is made possible after a receipt of the above edge detecting signal and a distance between the paper edge detecting section 3 and each of a plurality of photosensitive drums (K3, Y3, M3, and C3) on a carrying belt.

The page data transfer time measuring unit 32 measures page data transfer time for each of a plurality of photosensitive drums (K3, Y3, M3, C3) and stops transferring page data after counting of page data transfer time to be determined based a predetermined length of the paper 12. Ordinarily, the counter being embedded in the above control section 34 plays this role.

The count stopping unit 33 stops counting all two or more photosensitive drums after transfer of page data of a plurality of photosensitive drums (K3, Y3, M3, and C3) is started.

The control section 34 controls the paper edge detecting section 3 (in the same manner as in the first embodiment), page data transfer starting unit 31, page data transfer time measuring unit 32, and count stopping unit 33 to transfer a desired image for each of the plurality of photosensitive drums and, when having received a sheet of paper having a length being larger than a length of the paper predetermined in advance, controls the count stopping unit 33 and receives an edge detecting signal to re-start counting so that transfer of page data to the paper having pages exceeding a pre-set number of counts is made possible.

That is, the control sections 34 serves as a CPU to control all portions in the image forming device. The page data transfer starting unit 5 and page data transfer time measuring unit 32, and count stopping unit 33 may be configured as a control program that operates the CPU. It is needless to say that these units 32 and 33 can be configured as an individual circuit. Moreover, a counter adapted to store a result calculated by these units as a counted number of sub-scanning clocks to be described later is internally provided.

The delay time storing section 35 calculates, in advance, delay time which is calculated from a carrying speed of the paper 12 and from a distance between the paper edge detecting section 3 and each of a plurality of photosensitive drums (K3, Y3, M3, and C3) on the carrying belt 1, which occurs between when edge detecting signal is received and when exposure can be started and to store the time. Since operations of other components are entirely same as those in the first embodiment, descriptions are omitted accordingly.

Figure 7:
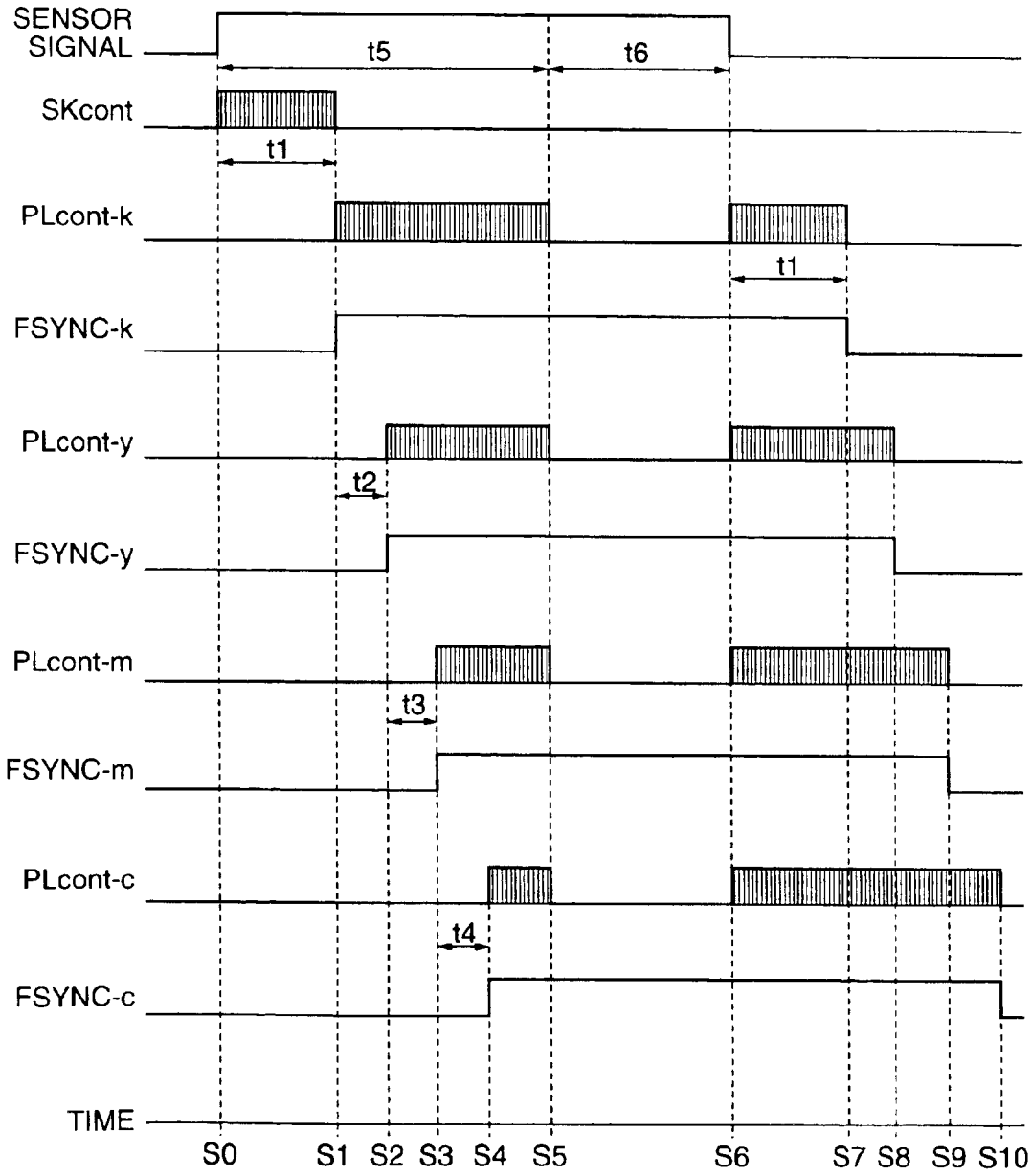
FIG. 7 is a time chart explaining operations of the image forming device according to the third embodiment of the present invention.

Next, operations of the image forming device of the third embodiment are described. FIG. 7 is a time chart explaining operations of an image forming device according to the third embodiment of the present invention. A sensor signal, SKcont (delay time of the exposure device k), PLcont-k (counting of paper length), FSYNC-k (page transfer signal), PLcont-y (counting of paper length), FSYNC-y (page transfer signal), PLcont-m (counting of paper length), FSYNC-m (page transfer signal), PLcont-c (counting of paper length), FSYNC-c (page transfer signal), and time are sequentially plotted as ordinate beginning with its top and a lapse of time is plotted as abscissa. Operations, at time S0 to S10 as shown in FIG. 7, of the image forming device of the third embodiment are described by using FIG. 6.

(Time S0)

The paper edge detecting section 3 having detected reach of an edge of the paper 12 inserted from the paper feeding roller 7 to the paper edge detecting section 3 feeds an edge detecting signal to the control section 34 (to make a sensor signal high). A portion corresponding to the photosensitive drum K3 of the page data transfer starting unit 31 reads delay time t1 of the photosensitive drum K3 from the delay time storing section 35 to start counting the SKcont (delay time of the exposure device K).

(Time S1)

The page data transfer starting unit 31, based on control of the control section 34, when delay time t1 of the photosensitive drum K3 has elapsed, makes the FSYNC-k (page transfer signal) high and starts transferring page data (image data) corresponding to the photosensitive drum K3. The LED controlling unit K1 controls the exposure device K2 to start producing an electrostatic latent image of a black image.

At the same time, the page data transfer time measuring unit 32, based on control of the control section 34, start counting page data transfer time (PLcont-k). At this time, a number of counts corresponding to a predetermined length of the paper is set to the page data transfer time measuring unit 32.

(Time S2)

The control section 34, when detecting the fact that time t2 elapsed since the time S1 by monitoring the PLcont-k, controls the page data transfer starting unit 31 to make the FSYNC-y high and then starts transferring page data (image data) corresponding the photosensitive drum Y3. The LED controlling unit Y1 controls the exposure device Y2 to start producing an electrostatic latent image of a yellow image on a charging face of the photosensitive drum Y3. Here, the time t2 is delay time of the photosensitive drum Y3 to the photosensitive drum K3 and is stored in advance in the delay time storing section 35.

At the same time, the page data transfer time measuring unit 32, based on control of the control section 34, start counting page data transfer time (by using the PLcont-y). At this time, a number of counts corresponding to a predetermined length of the paper is set to the page data transfer time measuring unit 32.

(Time S3)

The control section 34, when detecting the fact that time t2 elapsed since the time S1 by monitoring the PLcont-k, controls the page data transfer starting unit 31 to make the FSYNC-m high and then starts transferring page data (image data) corresponding the photosensitive drum M3. The LED controlling unit M1 controls the exposure device M2 to start producing an electrostatic latent image of a magenta image on a charging face of the photosensitive drum M3. Here, the time t3 is delay time of the photosensitive drum M3 to the photosensitive drum Y3 and is stored in advance in the delay time storing section 35.

At the same time, the page data transfer time measuring unit 32, based on control of the control section 34, starts counting page data transfer time (by using PLcont-m). At this time, a number of counts corresponding to a predetermined length of the paper is set to the page data transfer time measuring unit 32.

(Time S4)

The control section 34, when detecting the fact that time t4 elapsed since the time S3 by monitoring the PLcont-m, controls the page data transfer starting unit 31 to make the FSYNC-c high and then starts transferring page data (image data) corresponding the photosensitive drum C3. The LED controlling unit C1 controls the exposure device C2 to start producing an electrostatic latent image of a cyan image on a charging face of the photosensitive drum C3. Here, the time t4 is delay time of the photosensitive drum C3 to the photosensitive drum C3 and is stored in advance in the delay time storing section 35.

At the same time, the page data transfer time measuring unit 32, based on control of the control section 34, start counting page data transfer time (by using PLcont-c). At this time, a number of counts corresponding to a predetermined length of the paper is set to the page data transfer time measuring unit 32.

(Time S5)

When the paper having a predetermined length is inserted, the paper edge detecting section 3 detects an edge of the paper 12 and the control section 34 ought to transmit an edge detecting signal to the control section 34, that is, to make a sensor signal low. However, the control section 34, since the edge detecting signal has not yet been transmitted, judges that a length of the paper 12 being fed currently is larger than a predetermined length of the paper. The count stopping unit 33 controls to stop counting the PLcont-k (counting of paper length), PLcont-y (counting of paper length), PLcont-m (counting of paper length), and PLcont-c (counting of paper length) at the same time.

(Time S6)

An edge of the paper 12 having a length being larger than a predetermined length of the paper and having been inserted from the paper feeding roller 7 passes through the paper edge detecting section 3. The paper edge detecting section 3 transmits an edge detecting signal to the control section 34, that is, makes a sensor signal low. The control section 34 deactivates the count stopping unit 33 and restarts counting of the PLcont-k (counting of paper length), PLcont-y (counting of paper length), PLcont-m (counting of paper length), and PLcont-c (counting of paper length) at the same time.

(Time S7)

The control section 34, after completion of counting by the PLcont-k (counting of paper length), controls the page data transfer time measuring unit 32 and stops transfer of page data, that is, makes low the FSYNC-k (page transfer signal). At the same time, the control section 34 controls the LED controlling unit K1 and exposure device K2 and stops producing an electrostatic latent image of a black image on a charging face of the photosensitive drum K3.

Here, an attention should be given to following points. A length of the sheet of paper 12 being larger than expected originally corresponds to a length t5+t6 of a sensor signal. Here, "t5" corresponds to a predetermined length of the paper 12 and "t6" corresponds to a length of the paper 12 being excessively large. On the other hand, during the time "t6", counting by the PLcont-k (counting of the paper) is stopped. Therefore, the time from the time S6 to the time S7 coincides with delay time "t1" of the photosensitive drum K3.

(Time S8)

The control section 34, after completion of counting by the PLcont-y (counting of paper length), controls the page data transfer time measuring unit 32 and stops transfer of page data, that is, makes low the FSYNC-y (page transfer signal). At the same time, the control section 34 controls the LED controlling unit Y1 and exposure device Y2 and stops producing an electrostatic latent image of a black image on a charging face of the photosensitive drum Y3.

(Time S9)

The control section 34, after completion of counting by the PLcont-m (counting of paper length), controls the page data transfer time measuring unit 32 and stops transfer of page data, that is, makes low the FSYNC-m (page transfer signal). At the same time, the control section 34 controls the LED controlling unit M1 and exposure device M2 and stops producing an electrostatic latent image of a black image on a charging face of the photosensitive drum M3.

(Time S10)

The control section 34, after completion of counting by the PLcont-c (counting of paper length), controls the page data transfer time measuring unit 32 and stops transfer of page data, that is, makes low the FSYNC-c (page transfer signal). At the same time, the control section 34 controls the LED controlling unit C1 and exposure device C2 and stops producing an electrostatic latent image of a black image on a charging face of the photosensitive drum C3.

Effects of Third Embodiment

As explained above, by being provided with a page data transfer starting unit, count stopping unit, delay time storing unit and by temporarily stop counting while printing is being done, printing even on a sheet of paper having a length being larger than a predetermined one is made possible without a hitch.

Fourth Embodiment

Figure 8:
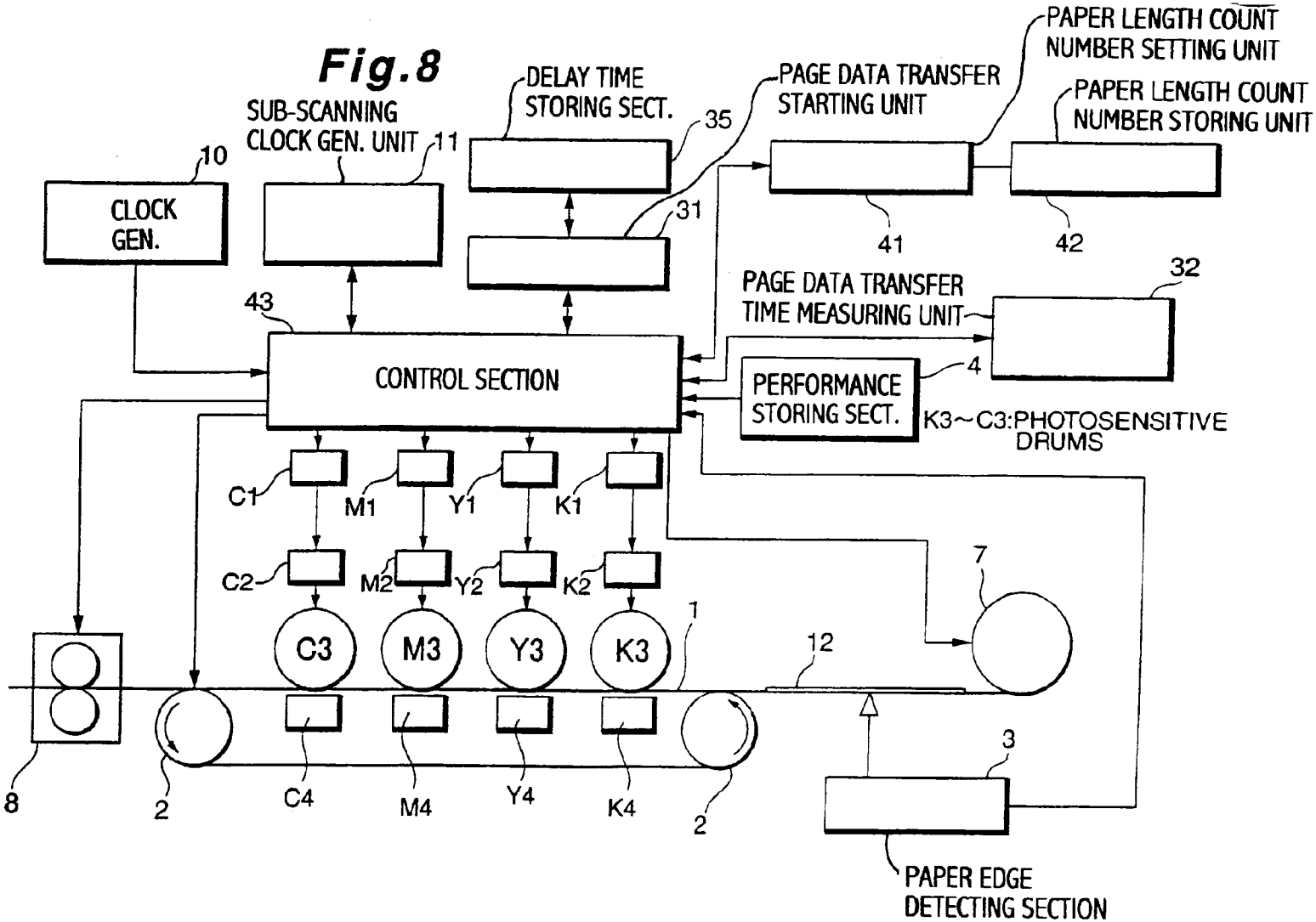
FIG. 8 is a schematic block diagram showing configurations of an image forming device according to a fourth embodiment of the present invention.

FIG. 8 is a schematic block diagram showing configurations of an image forming device according to a fourth embodiment of the present invention. The image forming device of the fourth embodiment as shown in FIG. 8 includes a carrying belt 1, a carrying roller 2, a paper edge detecting section 3, a device performance storing section 4, a paper feeding roller 7, a fixing device 8, a clock generator 10, a sub-scanning clock generating unit 11, a page data transfer starting unit 31, a page data transfer time measuring unit 32, a delay time storing section 35, a paper length counting number setting unit 41, a paper length counting number storing unit 42, a control section 43, an LED controlling units K1, Y1, and C1, exposure devices K2, Y2, M2, and C2, photosensitive drums K3, Y3, M3, and C3, and transfer devices K4, Y4, M4, and C4.

Only configurations of the image forming device of the third embodiment of the present invention being different from the first embodiment will be described. The paper length counting number setting unit 41 sets a number of counting according to a length of the paper 12 to the page data transfer time measuring unit 32 (same as in the third embodiment). The paper length counting number storing unit 42 stores a number of counting according to a length of the paper 12 scheduled to be inserted.

The control section 43, when having received pre-set paper, controls the paper length counting number setting unit 41 and, when the page data transfer starting unit 31 (same as in the third embodiment) starts transferring page data, beginning with the above upstream portion, in order, to a plurality of the above photosensitive drums (K3, Y3, M3, and C3), sequentially sets a number of counting according to a predetermined length of the paper 12 to the above page data transfer time measuring unit 32 (same as in the third embodiment).

That is, the control section 43 serves as a CPU adapted to control all components in the image forming device. The paper length counting number setting unit 41, page data transfer starting unit 31, photosensitive drums (K3, Y3, M3, and C3), and page data transfer time measuring unit 32 may be configured as a control program that operates the CPU. It is needless to say that these units can be configured as an individual circuit. Moreover, a counter adapted to store a result calculated by these units as a counted number of sub-scanning clocks to be described later is internally provided. Since other components are same as those in the embodiment 1 or the embodiment 3, descriptions are omitted accordingly.

Figure 9:
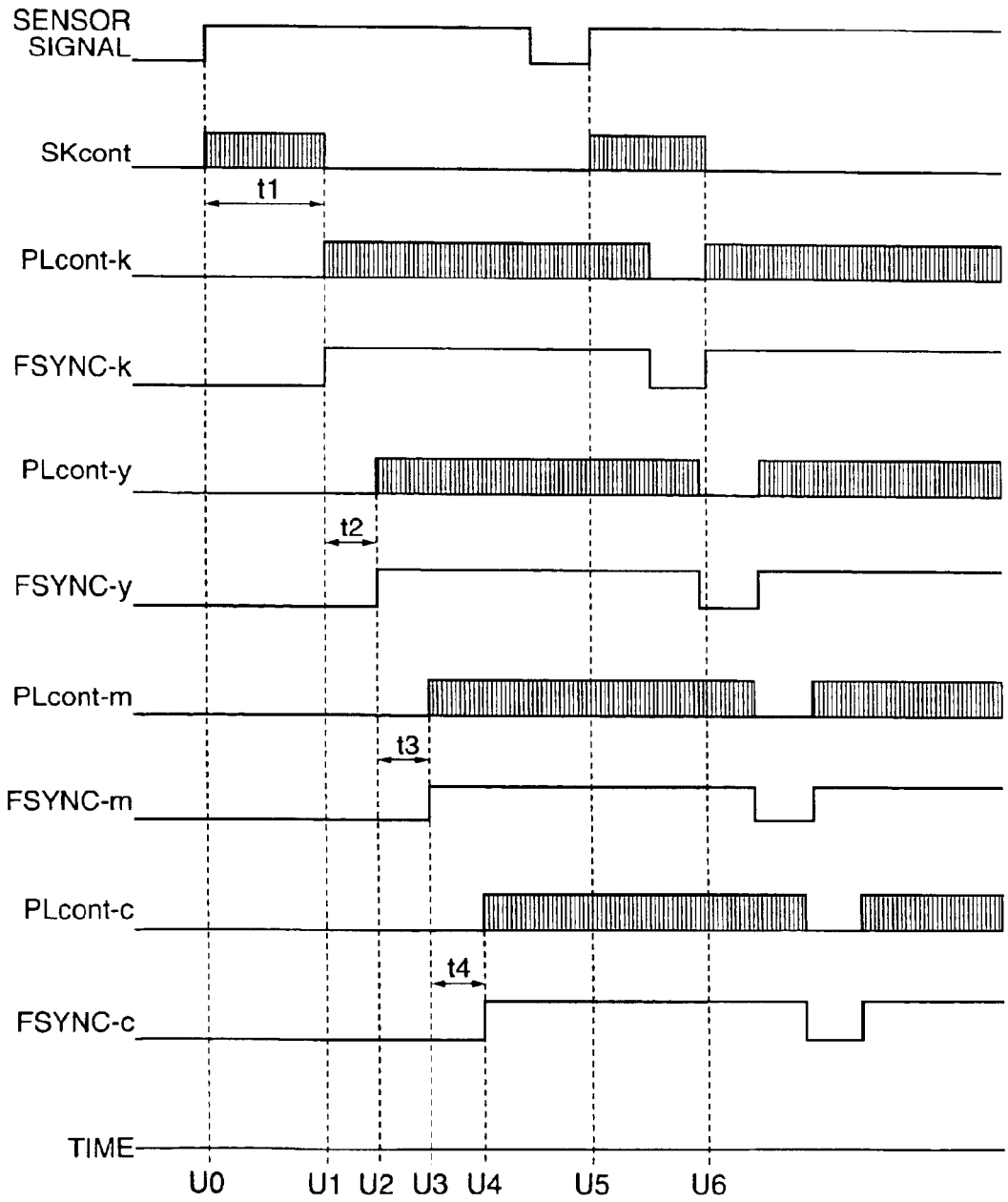
FIG. 9 is a time chart explaining operations of the image forming device according to the fourth embodiment of the present invention.

Next, operations of the fourth embodiment are described. FIG. 9 is a time chart explaining operations of an image forming device according to the fourth embodiment of the present invention.

A sensor signal, SKcont (delay time of exposure device K), PLcont-k (counting of paper length), FSYNC-k (page transfer signal), PLcont-y (paper length), PLcont-y (counting of paper length), FSYNC-y (page transfer signal), PLcont-m (counting of paper length), FSYNC-m (page transfer signal), PLcont-c (counting of paper length), FSYNC-c (page transfer signal), and time are sequentially plotted as ordinate beginning with its top and a lapse of time is plotted as abscissa. Operations, at time U0 to U5, as shown in FIG. 9, of the image forming device of the fourth embodiment are described by using FIG. 8.

(Time U0)

The paper edge detecting section 3 having detected reach of an edge of the paper 12 inserted from the paper feeding roller 7 to the paper edge detecting section 3 feeds an edge detecting signal to the control section 43, that is, makes a sensor signal high. A portion corresponding to the photosensitive drum K3 of the page data transfer starting unit 31 reads delay time t1 of the photosensitive drum K3 from the delay time storing section 35 to start counting the SKcont (delay time of the exposure device K).

(Time U1)

Based on control of the control section 43, the page data transfer starting unit 31, after a lapse of delay time t1 of the photosensitive drum K 3, makes high the FSYNC-k (page transfer signal) and starts transferring page data (image data) corresponding to the photosensitive drum K3. The LED controlling unit K1 controls the exposure device K2 to start producing an electrostatic latent image of a black image.

At this time, the control section 43 controls the paper length counting number setting unit 41 and sets a number of paper length counting corresponding to a length of the paper 12 flowing currently to the page data transfer time measuring unit 32. The number of paper length counting is stored in advance in the paper length counting number storing section 42. At the same time, the page data transfer time measuring unit 32, based on control of the control section 34, starts counting of the page data transfer time (by using the PLcont-k).

(Time U2)

The control section 43, by monitoring the PLcont-k (counting of paper length) and detecting a lapse of time t2 since the time U1, makes high FSYNC-y (page transfer signal) and starts transferring page data (image data) corresponding to the photosensitive drum Y3. The LED controlling unit Y1 controls the exposure device Y2 to start producing an electrostatic latent image of a yellow image. Here, "t2" is delay time of the photosensitive drum Y3 to the photosensitive drum K3 and is stored in advance in the delay time storing section 35.

At this time, the control section 43 controls the paper length counting number setting unit 41 and sets a number of paper length counting corresponding to a length of the paper 12 flowing currently to the page data transfer time measuring unit 32. The number of paper length counting is stored in advance in the page data transfer time measuring unit 32. The number of paper length counting is stored in advance in the paper length counting number storing section 42. At the same time, the page data transfer time measuring unit 32, based on control of the control section 34, starts counting of the page data transfer time (PLcont-y for counting of paper length).

(Time U3)

The control section 43, by monitoring the PLcont-y (counting of paper length) and detecting a lapse of time t3 since the time U2, makes high the FSYNC-m (page transfer signal) and starts transferring page data (image data) corresponding to the photosensitive drum M3. The LED controlling unit M1 controls the exposure device M2 to start producing an electrostatic latent image of a magenta image. Here, "t3" is delay time of the photosensitive drum M3 to the photosensitive drum Y3 and is stored in advance in the delay time storing section 35.

At this time, the control section 43 controls the paper length counting number setting unit 41 and sets a number of paper length counting corresponding to a length of the paper 12 flowing currently to the page data transfer time measuring unit 32. The number of paper length counting is stored in advance in the paper length counting number storing section 42. At the same time, the page data transfer time measuring unit 32, based on control of the control section 34, starts counting of the page data transfer time (by using PLcont-m for counting of paper length).

(Time U4)

The control section 43, by monitoring the PLcont-m (counting of paper length) and detecting a lapse of time t4 since the time U3, makes high the FSYNC-c (page transfer signal) and starts transferring page data (image data) corresponding to the photosensitive drum C3. The LED controlling unit C1 controls the exposure device C2 to start producing an electrostatic latent image of a cyan image. Here, "t4" is delay time of the photosensitive drum C3 to the photosensitive drum C3 and is stored in advance in the delay time storing section 35.

At this time, the control section 43 controls the paper length counting number setting unit 41 and sets a number of paper length counting corresponding to a length of the paper 12 flowing currently to the page data transfer time measuring unit 32. The number of paper length counting is stored in advance in the paper length counting number storing section 42. At the same time, the page data transfer time measuring unit 32, based on control of the control section 34, starts counting of the page data transfer time (by using PLcont-c for counting of paper length). Thereafter, in the same manner as above, steps proceeds to time U5, and printing on page 2 and thereafter is done.

Effects of Fourth Embodiment

As explained above, by being provided with a paper length counting number setting unit and paper length counting number storing unit, in addition to components of the third embodiment, and by starting transferring page data, beginning with its upstream portion in order and, at this point, by setting a number of counting to the page data transfer time measuring unit, continuous printing on the paper having a different length according to a predetermined length of the paper is made possible.

Fifth Embodiment

Figure 10:
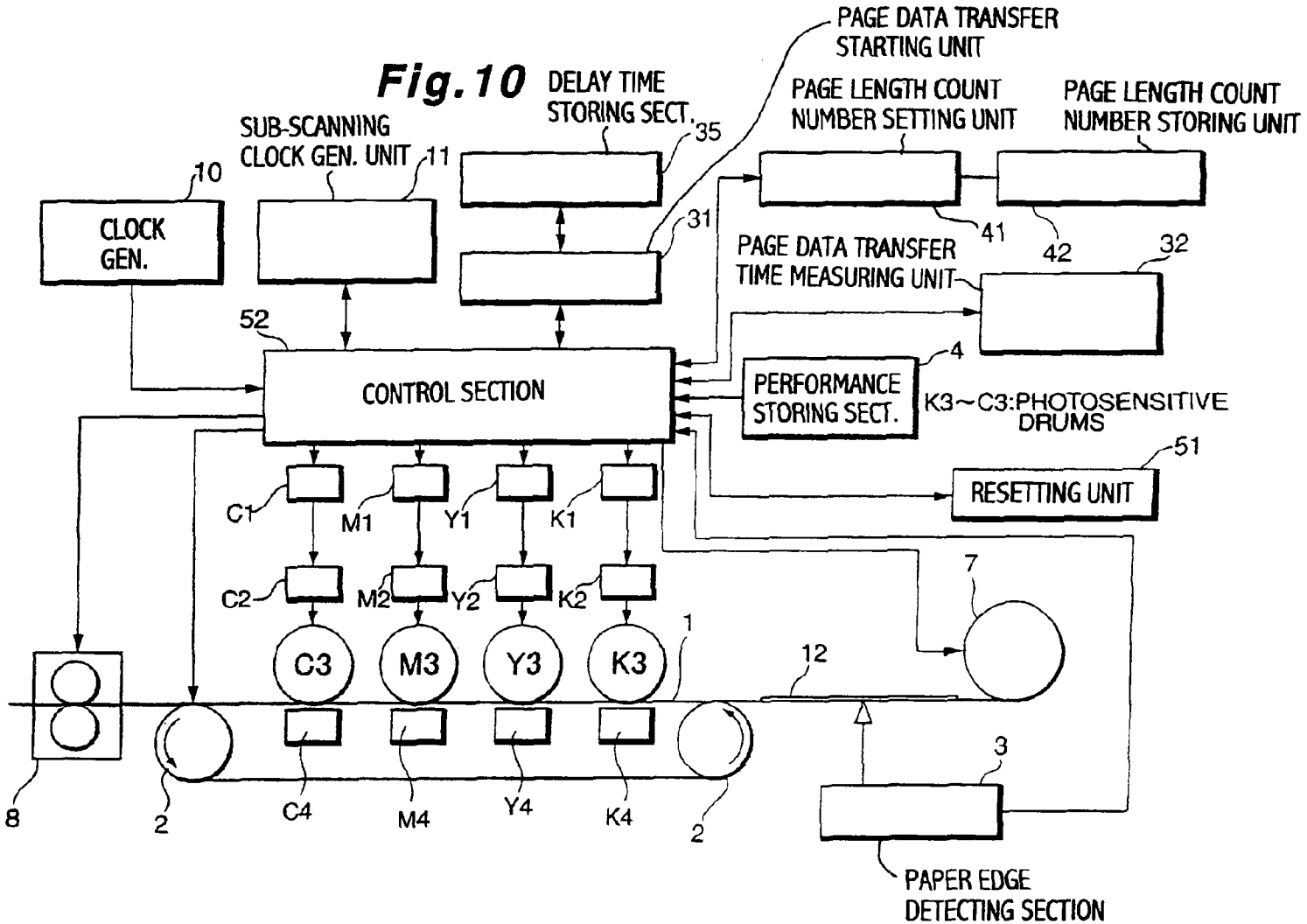
FIG. 10 is a schematic block diagram showing configurations of an image forming device according to a fifth embodiment of the present invention.

FIG. 10 is a schematic block diagram showing configurations of an image forming device according to a fifth embodiment of the present invention. The image forming device of the fifth embodiment as shown in FIG. 10 includes a carrying belt 1, a carrying roller 2, a paper edge detecting section 3, a device performance storing section 4, a paper feeding roller 7, a fixing device 8, a clock generator 10, a sub-scanning clock generating unit 11, a page data transfer starting unit 31, a page data transfer time measuring unit 32, a delay time storing section 35, a paper length counting number setting unit 41, a paper length counting number storing unit 42, a counting number re-setting unit 51, a control section 52, LED controlling units K1, Y1, M1, and C1, exposure devices K2, Y2, M2, and C2, photosensitive drums K3, Y3, M3, and C3, and transfer devices K4, Y4, M4, and C4.

Only configurations of the image forming device of the fifth embodiment of the present invention being different from those of the fourth embodiment will be described. The counting number re-setting unit 51 resets a remaining number of counting while the page data transfer time measuring unit 32 is counting page data transfer time individually.

The control section 52 controls a paper edge detecting section 3, a page data transfer starting unit 31, a counting number and resetting unit 51, a paper length counting number setting unit 41, and a counting number resetting unit 51 to transfer a desired image by exposure to a plurality of the above photosensitive drums and also, when having received an edge detecting signal in the midcourse of counting of individual page data transfer time by the page data transfer time measuring unit 32, controls the counting number resetting unit 51 to reset a remaining number of the page data transfer time measuring unit 32 corresponding to a plurality of photosensitive drums being arranged sequentially from an upstream to a downstream in the above transfer direction. Since operations of other components are entirely same as those in the first, second, or third embodiment, descriptions are omitted accordingly.

Figure 11:
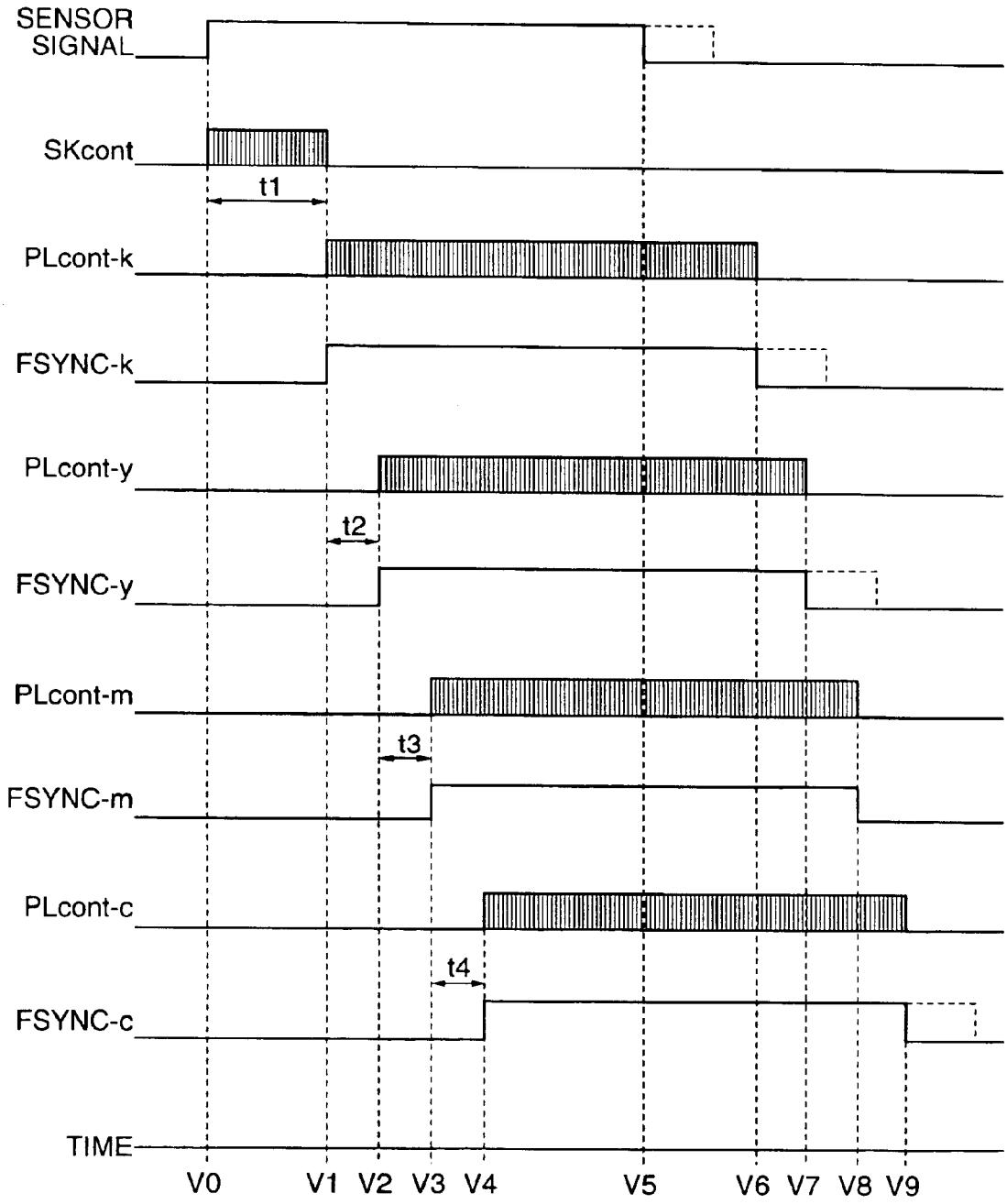
FIG. 11 is a time chart explaining operations of the image forming device according to the fifth embodiment of the present invention.

Next, operations of the image forming device of the fifth embodiment of the present invention are described. FIG. 11 is a time chart explaining operations of the image forming device according to the fifth embodiment. A sensor signal, SKcont (delay time of exposure device K), PLcont-k (counting of paper length), FSYNC-k (page transfer signal), PLcont-y (paper length), FSYNC-y (page transfer signal), PLcont-m (counting of paper length), FSYNC-m (page transfer signal), PLcont-c (counting of paper length), FSYNC-c (page transfer signal), and time are sequentially plotted as ordinate beginning with its top and a lapse of time is plotted as abscissa. Operations, at time V0 to V9, as shown in FIG. 11, of the image forming device of the fourth embodiment are described by using FIG. 11.

(Time V0)

The paper edge detecting section 3 having detected reach of an edge of the paper 12 inserted from the paper feeding roller 7 to the paper edge detecting section 3 feeds an edge detecting signal to the control section 52, that is, makes a sensor signal high. A portion corresponding to the photosensitive drum K3 of the page data transfer starting unit 31 reads delay time t1 of the photosensitive drum K3 from the delay time storing section 35 to start counting by the SKcont (delay time of the exposure device K).

(Time V1)

Based on control of the control section 52, the page data transfer starting unit 31, after a lapse of delay time t1 of the photosensitive drum K3, makes high the FSYNC-k (page transfer signal) and starts transferring page data (image data) corresponding to the photosensitive drum K3. The LED controlling unit K1 controls the exposure device K3 to start producing an electrostatic latent image of a black image.

At this time, the control section 52 controls the paper length counting number setting unit 41 and sets a number of paper length counting corresponding to a length of the paper 12 flowing currently to the page data transfer time measuring unit 32. The number of paper length counting is stored in advance in the paper length counting number storing section 42. At the same time, the page data transfer time measuring unit 32, based on control of the control section 34, starts counting of the page data transfer time (by using PLcont-k for counting of a paper length).

(Time V2)

The control section 52, by monitoring the PLcont-k (counting of paper length) and detecting a lapse of time t2 since the time U1, makes high the FSYNC-y (page transfer signal) and starts transferring page data (image data) corresponding to the photosensitive drum Y3. The LED controlling unit Y1 controls the exposure device Y2 to start producing an electrostatic latent image of a yellow image. Here, "t2" is delay time of the photosensitive drum Y3 to the photosensitive drum K3 and is stored in advance in the delay time storing section 35.

At this time, the control section 52 controls the paper length counting number setting unit 41 and sets a number of paper length counting corresponding to a length of the paper 12 flowing currently to the page data transfer time measuring unit 32. The number of paper length counting is stored in advance in the paper length counting number storing section 42. At the same time, the page data transfer time measuring unit 32, based on control of the control section 34, starts counting of the page data transfer time (by using the PLcont-y for counting a paper length).

(Time V3)

The control section 52, by monitoring the PLcont-y (counting of paper length) and detecting a lapse of time t3 since the time U2, makes high the FSYNC-m (page transfer signal) and starts transferring page data (image data) corresponding to the photosensitive drum M3. The LED controlling unit M1 controls the exposure device M2 to start producing an electrostatic latent image of a cyan image. Here, "t3" is delay time of the photosensitive drum M3 to the photosensitive drum C3 and is stored in advance in the delay time storing section 35.

At this time, the control section 52 controls the paper length counting number setting unit 41 and sets a number of paper length counting corresponding to a length of the paper 12 flowing currently to the page data transfer time measuring unit 32. The number of paper length counting is stored in advance in the paper length counting number storing section 42. At the same time, the page data transfer time measuring unit 32, based on control of the control section 34, starts counting of the page data transfer time (by using the PLcont-m for counting of a paper length).

(Time V4)

At this time, the control section 52, by monitoring the PLcont-m (counting of paper length) and detecting a lapse of time t4 since the time U3, makes high the FSYNC-c (page transfer signal) and starts transferring page data (image data) corresponding to the photosensitive drum C3. The LED controlling unit C1 controls the exposure device C2 to start producing an electrostatic latent image of a cyan image. Here, "t4" is delay time of the of the photosensitive drum M3 to the photosensitive drum C3 and is stored in advance in the delay time storing section 35.

At this time, the control section 52 controls the paper length counting number setting unit 41 and sets a number of paper length counting corresponding to a length of the paper 12 flowing currently to the page data transfer time measuring unit 32. The number of paper length counting is stored in advance in the paper length counting number storing section 42. At the same time, the page data transfer time measuring unit 32, based on control of the control section 34, starts counting of the page data transfer time (by using the PLcont-m for counting of a paper length).

(Time V5)

If paper having a predetermined length is inserted, the paper edge detecting section 3 ought not to detect an edge of the paper 12, however, the control section 52 receives an edge detecting signal from the paper edge detecting section 3 (that is, makes low the sensor signal). At this time, the control section 52 judges that a length of the paper 12 flowing currently is shorter than the predetermined length of the paper 12. Then, the control section 52 controls the counting number re-setting unit 51 so as to read delay time "t1" of the photosensitive drum K3 from the delay time storing section 35 and so as to reset a value counted by the page data delay time measuring unit 32 to a counting number being equivalent to the time t1.

(Time V6)

The control section 52, after completion of counting by the PLcont-k (counting of paper length), controls the counting number resetting unit 51 so as to read delay time t2 and to reset a value counted by the page data transfer time measuring unit 32 to a counting number being equivalent to the time t2.

The control section 52, after completion of counting by the PLcont-k (counting of paper length), controls the page data transfer time measuring unit 32 to stop transferring page data, that is, makes low the FSYNC-k. At the same time, the control section 52 controls the LED controlling unit K1 and exposure device K2 to stop producing an electrostatic latent image of a black image on a charging face of the photosensitive drum K3.

(Time V7)

The control section 52, after completion of counting by the PLcont-y (counting of paper length), controls the counting number resetting unit 51 so as to read delay time t2 between the photosensitive drum Y3 and the photosensitive drum M3 from the delay time storing section 35 and to reset a value counted by the page data transfer time measuring unit 32 to a counting number being equivalent to the time t2.

The control section 52, after completion of counting by the PLcont-y (counting of paper length), controls the page data transfer time measuring unit 32 to stop transferring page data, that is, makes low the FSYNC-y for page transfer signal. At the same time, the control section 52 controls the LED controlling unit K1 and exposure device K2 to stop producing an electrostatic latent image of a yellow image on a charging face of the photosensitive drum Y3.

(Time V8)

The control section 52, after completion of counting by the PLcont-m (counting of paper length), controls the counting number resetting unit 51 so as to read delay time t2 between the photosensitive drum M3 and the photosensitive drum C3 from the delay time storing section 35 and to reset a count value of the PLcont-c (counting of paper length) to a counting number being equivalent to the time t4.

The control section 52, after completion of counting by the PLcont-m (counting of paper length), controls the page data transfer time measuring unit 32 to stop transferring page data, that is, makes low the FSYNC-m (page transfer signal). At the same time, the control section 52 controls the LED controlling unit M1 and exposure device M2 to stop producing an electrostatic latent image of a magenta image on a charging face of the photosensitive drum M3.

(Time V9)

Counting by the PLcont-c (counting of paper length) is completed. After completion of the control PLcont-c (counting of paper length), the page data transfer time measuring unit 32 is controlled to stop transfer of the page data, that is, makes low the FSYNC-c (page transfer signal). At the same time, the control section 52 controls the LED controlling unit C1 and the exposure device C2 to stop producing an electrostatic latent image of a cyan image of the photosensitive drum C3. Printing has been now completed.

In the above embodiments, the control section 52 controls the counting number resetting unit 51 to reset paper length counting value sequentially beginning with the upstream portion. However, in the fifth embodiment, the present invention is not limited to this way of operations. For example, at time V5, a value counted by the PLcont-k may be set to a counting value being equivalent to the time t1 and, at the same time, a value counted by the PLcont-y may be set to a counting value being equivalent to the time t1+t2 and a value counted by the PLcont-c (counting of paper length) may be set to a counting value being equivalent to the time t1+t2+t3+t4, collectively as a whole.

Effects of Fifth Embodiment

As described above, since the control section, when having received an edge detecting signal in the midcourse of counting of individual transfer time by the page data transfer time measuring unit, controls counting number resetting unit to reset a remaining counting number of the page data transfer time measuring unit corresponding to a plurality of the photosensitive drums being arranged sequentially from its upstream to a downstream in the carrying direction, printing even on a sheet of paper having a length being smaller than a predetermined one is made possible without a hitch.

It is apparent that the present invention is not limited to the above embodiments but may be changed and modified without departing from the scope and spirit of the invention.

What is claimed is:

1. An image forming device comprising:

a plurality of image forming sections for forming an image and respectively arranged apart by a specified distance in a paper carrying direction of a paper carrying path;

a paper edge detecting section for detecting front and back edges of said paper as said paper is carried along said paper carrying path, and placed at an upstream side of said paper carrying path; and a control section for controlling said plurality of image forming sections, based on information that includes information of said edges detected by said paper edge detecting section, said control section judging whether all of said image will fit onto said page and, if said page is too short to receive all of said image, transferring only a portion of image data defining said image to said image forming sections to cause said image forming sections to truncate said image to fit it on said page.

2. The image forming device according to claim 1, further comprising:

a page data transfer starting unit;

a page data transfer time measuring unit; and a count stopping unit, wherein said paper edge detecting section is placed nearer to the upstream side than each of said plurality of image forming sections, detects a front edge of paper being carried on said paper carrying path and outputs a front edge detecting signal, and detects a back edge of paper and outputs an back edge detecting signal;

wherein said page data transfer starting unit starts a transfer of page data after a lapse of each of a plurality of delay times occurring between a receipt of said front edge detecting signal and a start of exposure which is calculated from a carrying speed of said paper and a distance between said paper edge detecting section and said plurality of image forming sections;

wherein said page data transfer time measuring unit individually counts a page data transfer time for each of said plurality of image forming sections and stops transfer of page data after reaching a predetermined count;

wherein said count stopping unit has said plurality of image forming sections stop all counting of said plurality of said image forming sections after transfer of page data has been started; and wherein said control section controls said paper edge detecting section, said page data transfer starting unit, said page data transfer time measuring unit, and said count stopping unit so as to transfer a desired image for each of said plurality of said image forming sections and, at a same time, when paper having a length larger than that having a pre-set length is received, controls said count stopping unit so as to stop counting and to receive said back edge detecting signal from said paper edge detecting section which causes counting to be restarted to enable a transfer of page data.

3. The image forming device according to claim 2, wherein said page data transfer starting unit includes a delay time storing section to calculate, in advance, and to store individual delay times occurring between a receipt of said front edge detecting signal and a start of exposure which is calculated from a carrying speed of said paper and a distance between said paper edge detecting section and said plurality of image forming sections along said paper carrying path.

4. The image forming device according to claim 1, further comprising:

a page data transfer starting unit;

a page data transfer time measuring unit; and a paper length counting number setting unit, wherein said paper edge detecting section is placed nearer to the upstream side than each of said plurality of image forming sections, detects a front edge of paper being carried on said paper carrying path and outputs a front edge detecting signal, and detects a back edge of paper and outputs a back edge detecting signal;

wherein said page data transfer starting unit starts a transfer of page data after a lapse of each of a plurality of delay times occurring between a receipt of said front edge detecting signal and a start of exposure which is calculated from a carrying speed of said paper and a distance between said paper edge detecting section and said plurality of image forming sections;

wherein said page data transfer time measuring unit individually counts a page data transfer time for each of said plurality of image forming sections and stops transfer of page data after completion of a predetermined number of counting;

wherein said paper length counting number setting unit sets a counting number corresponding to said paper length to a page data transfer time measuring unit; and wherein said control section controls said paper edge detecting section, said page data transfer starting unit, said page data transfer time measuring unit and said paper length counting number setting unit so as to transfer a desired image by exposure for each of said plurality of image forming sections and, when having received predetermined paper, controls said paper length counting number setting unit so as to set, when the page transfer starting unit has started transfer of page data to said plurality of image forming sections sequentially beginning from said upstream side, sequentially counting numbers corresponding to said predetermined paper length to said page data transfer time measuring unit.

5. The image forming device according to claim 4, wherein said page data transfer starting unit includes a delay time storing section to calculate, in advance, and to store individual delay times occurring between a receipt of said edge detecting signal and a start of exposure which is calculated from a carrying speed of said paper and a distance between said paper edge detecting section and said plurality of image forming sections along said paper carrying path.

6. The image forming device according to claim 4, wherein said paper length counting number setting unit has a paper length counting number storing section.

7. The image forming device according to claim 1, further comprising:

a page data transfer starting unit;

a page data transfer time measuring unit;

a paper length counting number setting unit; and a count number re-setting unit, wherein said paper edge detecting section is placed nearer to the upstream side than each of said plurality of image forming sections, detects a front edge of paper being carried on said paper carrying path and outputs a front edge detecting signal, and detects a back edge of paper and outputs a back edge detecting signal;

wherein said page data transfer starting unit starts a transfer of page data after a lapse of each of a plurality of delay times occurring between a receipt of said end detecting signal and a start of exposure which is calculated from a carrying speed of said paper and a distance between said paper edge detecting section and said plurality of image forming sections along said paper carrying path;

wherein said page data transfer time measuring unit individually counts page data transfer times for each of said plurality of image forming sections and stops transfer of page data after completion of a predetermined counting number;

wherein said paper length counting number setting unit sets a counting number corresponding to said paper length to a page data transfer time measuring unit;

wherein said count number re-setting unit resets a remaining counting number while said page data transfer time measuring unit is individually counting page data transfer time; and wherein said control Section controls said paper edge detecting section, said page data transfer starting unit, said page data transfer time measuring unit, said paper length counting number setting unit, and said counting number re-setting unit so as to transfer a desired image for exposure by each of said plurality of image forming sections and, when having received said back edge detecting signal during a period of time when said page data transfer time measuring unit is individually counting page data transfer data, controls said counting number resetting unit so as to reset remaining counting numbers of said page data transfer time measuring unit corresponding to said plurality of image forming sections.

8. The image forming device according to claim 7, wherein said control section, when having received said back edge detecting signal, controls said counting number resetting unit so as to reset the remaining counting number of said page data transfer time measuring unit corresponding to a first image forming section that is arranged in order from the upstream side of said paper carrying path to a downstream side thereof to a counting number equivalent to said delay time and, when said counting is terminated, sequentially resets said remaining counting number corresponding to a subsequent image forming section to a number equivalent to a time obtained by subtracting a delay time of a subsequent image forming section from a delay time of an image forming section existing one ahead.

9. The image forming device according to claim 1, wherein said control section judges a length of said paper based on information of said edge detected by said paper edge detecting section, and controls image data to be outputted to said plurality of image forming sections, based on a length of an image inputted.

10. The image forming device according to claim 9, wherein the image inputted has a size, and if said length of said image inputted is shorter than said size of said image, said control section, with respect to each said image forming section, restrains the output of said image data corresponding to a part exceeding said length of said paper.

11. The image forming device according to claim 1, wherein said control section comprises calculating section which produces a calculation result that is based, at least in part, on back edge information generated by said paper edge detecting section, and wherein the control section employs said calculation result to control said image forming sections.

12. An image forming device according to claim 1, wherein each image forming section comprises an exposure unit and a controlling unit for sending image data to the exposure unit.

13. An image forming device according to claim 12, wherein said paper has a length dimension and said control section comprises a calculation portion which calculates the length of said paper on the basis of information of said front and back edges.

14. An image forming device according to claim 13, wherein said control section further comprises a comparing and judging portion which compares the length of said paper with the length of said image and judges whether the length of said paper is shorter than the length of said image, and wherein the exposure units of said image forming sections stop sending image data to the exposure units of said image forming sections when the length of said paper is shorter than the length of said image and thereby avoid sending excess image data that would exceed the length of said paper.

15. An image forming device comprising:

a plurality of image forming sections that are used for forming an image and respectively arranged apart by a specified distance in a paper carrying direction of a paper carrying path;

a paper edge detecting section which is used for detecting an edge of said paper as said paper is carried along said paper carrying path, and placed at an upstream side of said paper carrying path;

a control section to control said plurality of image forming sections based on the information of said edge detected by said paper edge detecting section;

an exposure start time calculating unit; and an exposure inhibiting time calculating unit, wherein said paper edge detecting section is placed nearer to the upstream side than each of said plurality of image forming sections in said carrying direction, detects a front edge of the paper being carried on said paper carrying path and outputs a front edge detecting signal, detects a back edge of the paper, and outputs an abnormal back edge detecting signal if the paper has a length that is shorter than a predetermined length;

wherein said exposure start time calculating unit respectively calculates, when said front edge detecting signal is output by said paper edge detecting section, exposure start times for each of said plurality of image forming sections based on a carrying speed of said paper and a distance between said paper edge detecting section and said image forming section;

wherein said exposure inhibiting time calculating unit respectively calculates, when said abnormal back edge detecting signal is output by said paper edge detecting section, exposure inhibiting times for each of sad plurality of image forming sections based on the carrying speed of said paper and the distance between said paper edge detecting section and said image forming section; and wherein said control section controls said paper edge detecting section, said exposure start time calculating unit and said exposure inhibiting time calculating unit to transfer a desired image by exposure and to inhibit exposure, when paper having a length smaller than the predetermined length is inserted, where the image would not be received by the paper having a length smaller than the predetermined length for each of said plurality of image forming sections.

16. The image forming device according to claim 15, further comprising a sub-scanning clock generating unit to produce a sub-scanning clock signal which enables fine line feeding that provides a line feeding interval shorter than that for an image transferred from an outside device, and wherein said control section exerts control based on said sub-scanning clock producing unit.

17. The image forming device according to claim 16, wherein the distance between said paper edge detecting section and the image forming section that is located highest upstream is such that, if a circumdistance from an exposure position to a transfer position on said image forming section is designated as L1 and a horizontal distance from said transfer position to said paper edge detecting section is designated as L2, a relation of L1<L2 is realized.

18. The image forming device according to claim 15, wherein the distance between said paper edge detecting section and the image forming section that is located highest upstream is such that, if a circumdistance from an exposure position to a transfer position on said image forming section is designated as L1 and a horizontal distance from said transfer position to said paper edge detecting section is designated as L2, a relation of L1<L2 is realized.

19. An image forming device comprising:

a plurality of image forming sections that are used for forming an image and respectively arranged apart by a specified distance in a paper carrying direction of a paper carrying path;

a paper edge detecting section which is used for detecting an edge of said paper as said paper is carried along said paper carrying path, and placed at an upstream side of said paper carrying path;

a control section to control said plurality of image forming sections based on the information of said edge detected by said paper edge detecting section;

an image data feeding start time calculating unit; and a blank data feeding time calculating unit, wherein said paper edge detecting section is placed nearer to the upstream side than each of said plurality of image forming sections, detects a front edge of the paper being carried on said paper carrying path and outputs a front edge detecting signal, detects a back edge of the paper, and outputs an abnormal back edge detecting signal if the paper has a length that is shorter than the predetermined length;

wherein said image data feeding start time calculating unit respectively calculates, when said front edge detecting signal is output by said paper edge detecting section, image data feeding start times for each of said plurality of image forming sections based on a carrying speed said paper and a distance between said paper edge detecting section and said image forming section;

wherein said blank data feeding time calculating unit respectively calculates, when said abnormal back edge detecting signal is output by said paper edge detecting section, feeding start times of blank data based on the carrying speed of said paper and the distance between said paper edge detecting section and said image forming section, and respectively calculates feeding terminating times of blank data based on the carrying speed of said paper, the distance between said edge detecting section and said image forming section and a preset length of paper, for each of said plurality of image forming sections; and wherein said control section controls said paper edge detecting section, said image data feeding time calculating unit, and said blank data feeding time calculating unit to transfer a desired image by exposure for each of said plurality of image forming sections and, when paper having a length being smaller than the preset length is received, to transfer blank data for exposure where the image would not be received by the paper having a length smaller than the preset length for each of said plurality of image forming sections.

20. The image forming device according to claim 19, further comprising a sub-scanning clock signal generating unit to produce a sub-scanning clock which enables fine line feeding that provides a line feeding interval shorter than that for an image transferred from an outside device, and wherein said control section exerts control based on said sub-scanning clock producing unit.

21. The image forming device according to claim 19, wherein the distance between said paper edge detecting section and the image forming section that is located highest upstream is such that, if a circumdistance from an exposure position to a transfer position on said image forming section is designated as L1 and a horizontal distance from said transfer position to said paper edge detecting section is designated as L2, a relation of L1<L2 is realized.

* * * * *